US008190067B2

(12) United States Patent
Suganuma

(10) Patent No.: US 8,190,067 B2
(45) Date of Patent: May 29, 2012

(54) DEVELOPING DEVICE, TONER CARTRIDGE, PROCESS CARTRIDGE, AND IMAGE FORMING APPARATUS INCLUDING A DEVELOPER GUIDE MEMBER

(75) Inventor: Takuya Suganuma, Yamato (JP)

(73) Assignee: Ricoh Company, Ltd., Tokyo (JP)

( * ) Notice: Subject to any disclaimer, the term of this patent is extended or adjusted under 35 U.S.C. 154(b) by 622 days.

(21) Appl. No.: 12/292,984

(22) Filed: Dec. 2, 2008

(65) Prior Publication Data

US 2009/0180811 A1 Jul. 16, 2009

(30) Foreign Application Priority Data

Dec. 3, 2007 (JP) ..... 2007-312464
Sep. 30, 2008 (JP) ..... 2008-252622

(51) Int. Cl.
*G03G 15/08* (2006.01)

(52) U.S. Cl. ..... 399/258; 399/263

(58) Field of Classification Search ..... 399/254, 399/258, 262, 263
See application file for complete search history.

(56) References Cited

U.S. PATENT DOCUMENTS 7,522,851 B2 * 4/2009 Koyama et al. ..... 399/258
7,711,291 B2 * 5/2010 Otani ..... 399/258

FOREIGN PATENT DOCUMENTS

| | | |
|---|---|---|
| JP | 5-011605 | 1/1993 |
| JP | 2000-056549 | 2/2000 |
| JP | 3320954 | 6/2002 |
| JP | 2005-031299 | 2/2005 |
| JP | 2006-053322 | 2/2006 |
| JP | 2006-221101 | 8/2006 |
| JP | 2007-178619 | 7/2007 |
| JP | 2007-183519 | 7/2007 |

* cited by examiner

*Primary Examiner* — William J Royer

(74) *Attorney, Agent, or Firm* — Harness, Dickey & Pierce, P.L.C.

(57) ABSTRACT

A developing device including a developer container configured to store a developer and a developing unit provided below the developer container. The developer container includes a first developer agitation member, and a developer guide member extending along a rotation path of the first developer agitation member, configured to conform to a shape of the rotation path. The developing unit includes a developer bearing member and a restriction member. The developer guide member prevents the developer from being directly supplied to a restriction nip formed between the developer bearing member and the restriction member and guides the developer to the developer bearing member. An edge of the developer guide member is positioned between the restriction nip and a center of rotation of the first developer agitation member.

20 Claims, 14 Drawing Sheets

DEVELOPING DEVICE, TONER CARTRIDGE, PROCESS CARTRIDGE, AND IMAGE FORMING APPARATUS INCLUDING A DEVELOPER GUIDE MEMBER

PRIORITY STATEMENT

The present patent application claims priority from Japanese Patent Application Nos. 2007-312464, filed on Dec. 3, 2007 in the Japan Patent Office, and 2008-252622, filed on Sep. 30, 2008 in the Japan Patent Office, the entire contents of each of which are hereby incorporated herein by reference.

BACKGROUND

1. Technical Field

Illustrative embodiments generally relate to a developing device configured to develop images formed by an image forming apparatus with a developer including toner; a toner cartridge employed in the developing device; a process cartridge including the developing device; and an image forming apparatus employing the developing device, the toner cartridge, and the process cartridge.

2. Description of the Related Art

Related-art image forming apparatuses, such as a copier, a facsimile machine, a printer, or a multifunction printer having two or more of copying, printing, scanning, and facsimile functions, form a toner image on a recording medium (e.g., a sheet) according to image data using an electrophotographic method. In such a method, for example, a charger charges a surface of an image bearing member (e.g., a photoconductor); an irradiating device emits a light beam onto the charged surface of the photoconductor to form an electrostatic latent image on the photoconductor according to the image data; a developing device develops the electrostatic latent image with a developer (e.g., toner) to form a toner image on the photoconductor; a transfer device transfers the toner image formed on the photoconductor onto a sheet; and a fixing device applies heat and pressure to the sheet bearing the toner image to fix the toner image onto the sheet. The sheet bearing the fixed toner image is then discharged from the image forming apparatus.

An example of the developing device includes a one-component developing device. For example, the one-component developing device may supply toner stored in a container to a developing roller using a toner supply roller. The developing roller is pressed against a restriction blade made of metal to equalize an amount of the toner supplied to the developing roller. The toner on the developing roller is then supplied to a photoconductor to develop the electrostatic latent image formed on the photoconductor.

The toner deteriorates as it passes repeatedly between the toner supply roller and the developing roller, and the developing roller and the restriction blade in the one-component developing device. Further, when the toner not used for development is returned to the container from the developing roller, heavy friction occurs between the toner and an agitator provided in the container to agitate the toner. As a result, deterioration of the toner is accelerated, thereby degrading chargeability of the toner.

The agitator may, for example, have a paddle-like shape. An agitator 140 having a paddle-like shape illustrated in FIG. 1 can agitate and convey the toner with greater force. However, the greater force causes greater stress on the toner, thereby degrading the toner.

To reduce stress on the toner, the agitator may have a wire or plate member. Because such an agitator does not have a larger area in a direction of rotation thereof, collision between the agitator and the toner can be reduced. For example, Published unexamined Japanese Patent Application No. H05-11605 discloses a developing device including an agitator 25 having a U-shaped wire member in a toner container 24 as illustrated in FIG. 2. The agitator 25 is rotated in an area lower than a protrusion 7 to agitate the toner in the toner container 24 to supply the toner to a developing roller 26. Because the agitator 25 including the U-shaped wire member does not cause larger stress to the toner, the problem of deterioration in the toner can be solved. However, another problem may arise in that the toner cannot be sufficiently agitated and smoothly conveyed by the agitator 25.

SUMMARY

In view of the foregoing, illustrative embodiments provide a developing device configured to reliably convey a developer to a developer supply member without degrading the developer, a toner cartridge, a process cartridge, and an image forming apparatus including the developing device, the toner cartridge, and the process cartridge.

At least one embodiment provides a developing device including a developer container configured to store a developer and a developing unit provided below the developer container. The developer container includes a first developer agitation member configured to agitate and convey the developer, and a developer guide member extending along a rotation path of the first developer agitation member, configured to conform to a shape of the rotation path. The developing unit includes a developer bearing member rotatably provided facing a latent image bearing member, configured to bear the developer to be supplied to the latent image bearing member, and a restriction member pressed against the developer bearing member to restrict an amount of the developer borne by the developer bearing member. The developer guide member prevents the developer from being directly supplied to a restriction nip formed between the developer bearing member and the restriction member and guides the developer to the developer bearing member. A height of a cross section of the developer agitation member in a shaft direction is gradually reduced from a maximum height thereof relative to a direction of rotation of the developer agitation member to reduce resistance to the developer. An edge of the developer guide member is positioned between the restriction nip and a center of rotation of the first developer agitation member.

At least one embodiment provides a toner cartridge detachably attachable to a developing device including a developer container configured to store a developer. The developer container includes a first developer agitation member configured to agitate and convey the developer, and a developer guide member extending along a rotation path of the first developer agitation member, configured to conform to a shape of the rotation path.

At least one embodiment provides a process cartridge detachably attachable to an image forming apparatus. The process cartridge includes an image bearing member, and the developing device described above.

At least one embodiment provides an image forming apparatus including a latent image bearing member configured to bear an electrostatic latent image, a charging device configured to charge a surface of the latent image bearing member, an irradiating device configured to scan and irradiate a charged surface of the latent image bearing member with a light beam according to image data to form an electrostatic latent image thereon, a developing device configured to develop the electrostatic latent image with a developer to form a toner image, a transfer device configured to transfer the toner image onto a recording medium, a fixing device configured to fix the toner image on the recording medium, and a cleaning device configured to remove toner particles remaining on the latent image bearing member. The developing device is the developing device described above.

Additional features and advantages of the illustrative embodiments will be more fully apparent from the following detailed description, the accompanying drawings, and the associated claims.

BRIEF DESCRIPTION OF THE DRAWINGS

A more complete appreciation of illustrative embodiments and the many attendant advantages thereof will be readily obtained as the same becomes better understood by reference to the following detailed description when considered in connection with the accompanying drawings, wherein.

Figure 1:
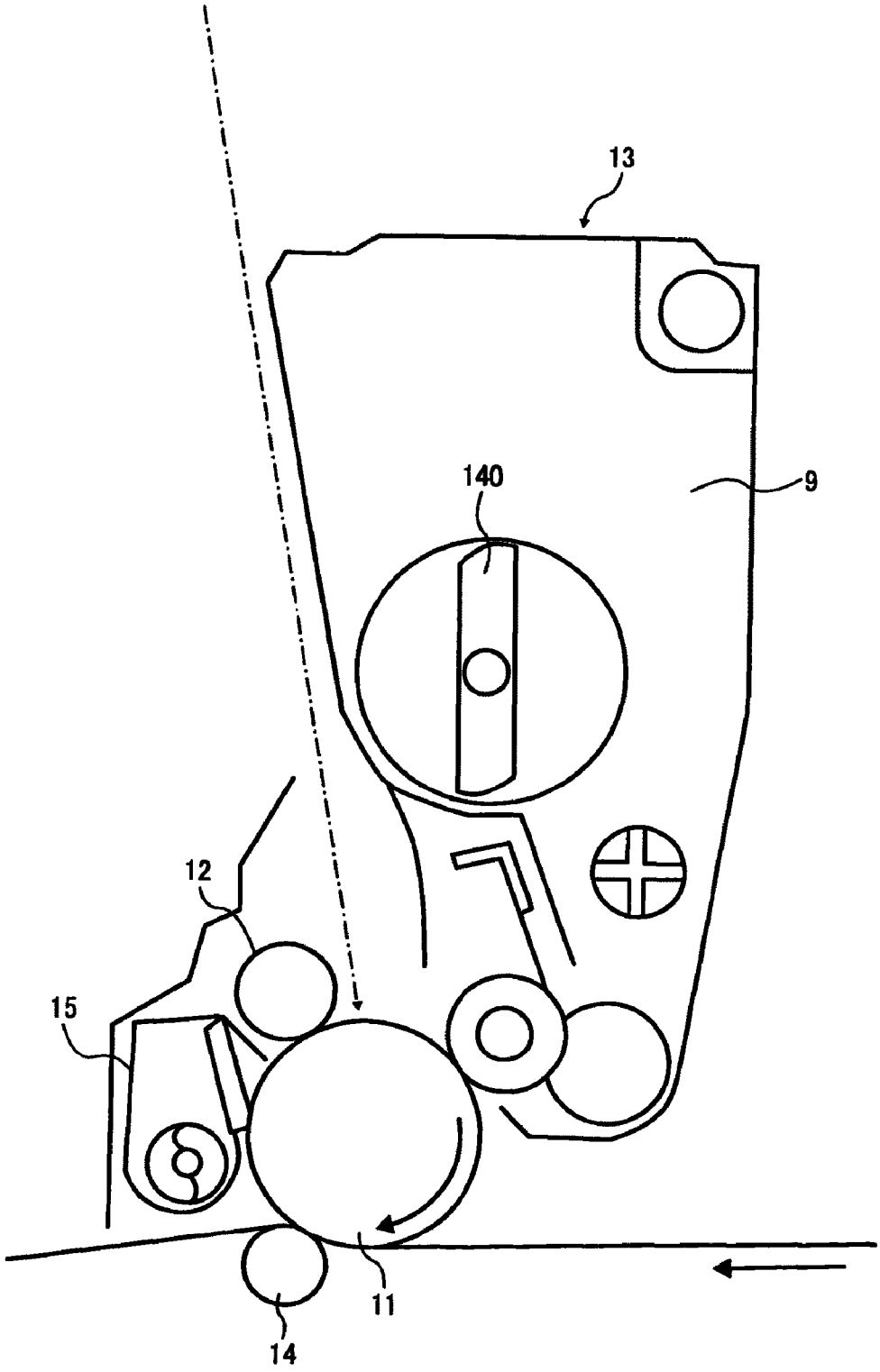
FIG. 1 RELATED ART
FIG. 1 is a schematic view illustrating an example of a related-art developing device.
Figure 2:
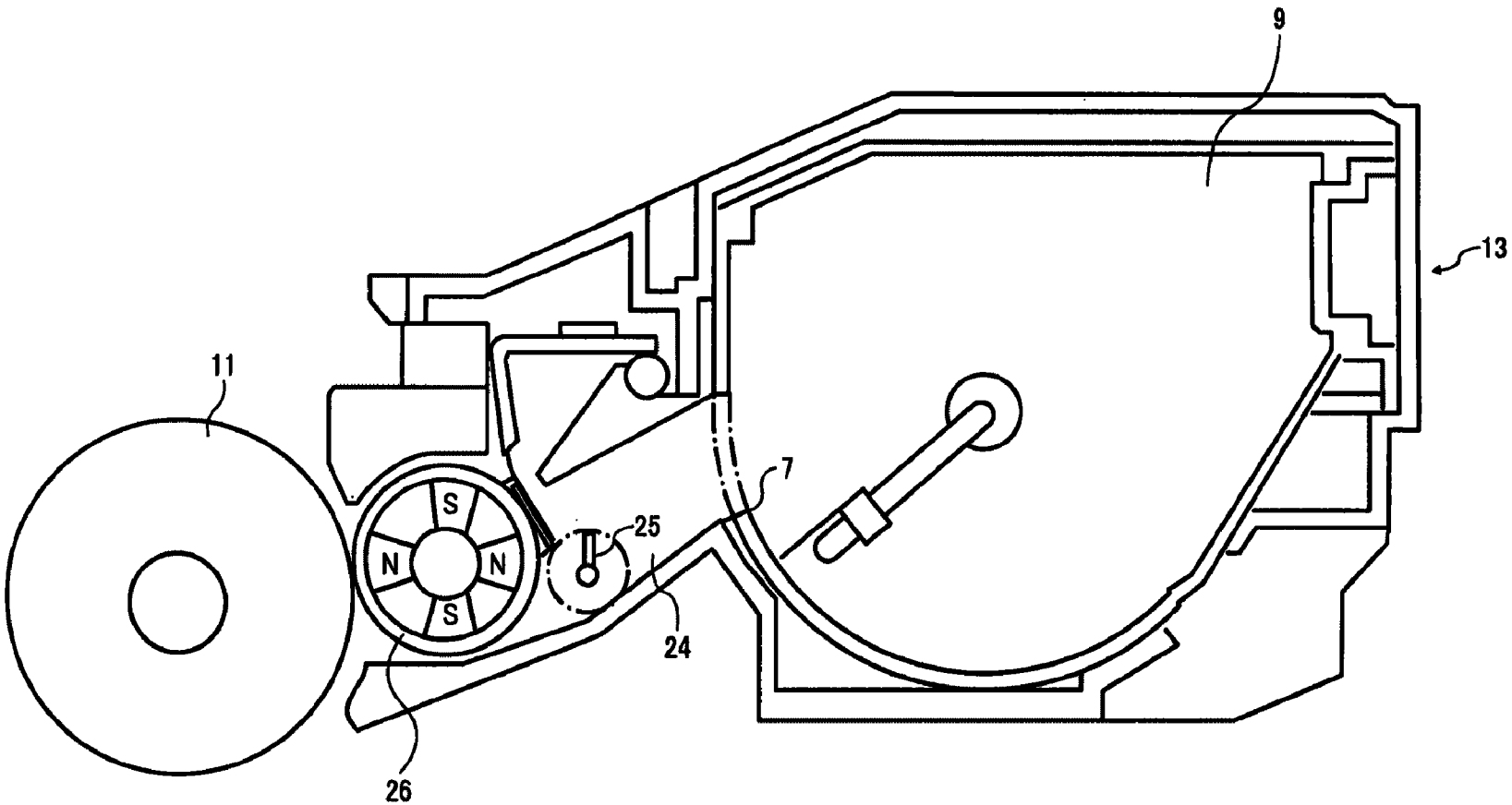
FIG. 2 RELATED ART
FIG. 2 is a schematic view illustrating another example of a related-art developing device.

The accompanying drawings are intended to depict illustrative embodiments and should not be interpreted to limit the scope thereof. The accompanying drawings are not to be considered as drawn to scale unless explicitly noted.

DETAILED DESCRIPTION OF ILLUSTRATIVE EMBODIMENTS

In describing illustrative embodiments illustrated in the drawings, specific terminology is employed for the sake of clarity. However, the disclosure of this specification is not intended to be limited to the specific terminology so selected, and it is to be understood that each specific element includes all technical equivalents that operate in a similar manner and achieve a similar result.

Reference is now made to the drawings, wherein like reference numerals designate identical or corresponding parts throughout the several views.

Figure 3:
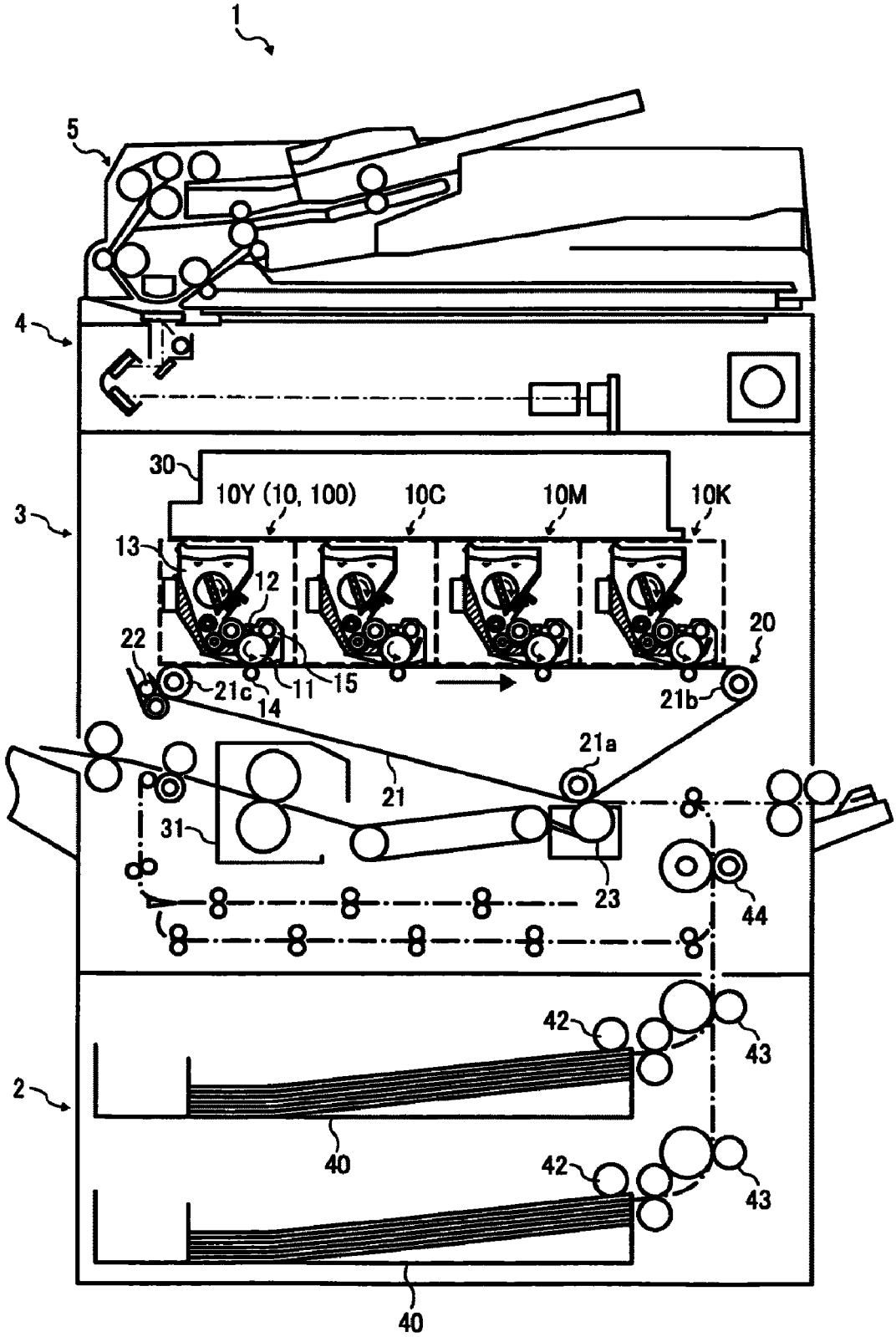
FIG. 3 is a schematic view illustrating an example of an image forming apparatus including a developing device according to illustrative embodiments.

A description is now given of a full-color image forming apparatus serving as an image forming apparatus 1 according to illustrative embodiments. FIG. 3 is a schematic view illustrating an example of the image forming apparatus 1 including a developing device 13 according to illustrative embodiments.

Referring to FIG. 3, the image forming apparatus 1 includes, as main components thereof, an automatic document feeder (ADF) configured to automatically convey original documents, a scanner 4 for reading the original documents, and an image forming unit 3 configured to form an image on a recording sheet based on a digital signal which is output from the scanner 4 and then electrically processed and output from an image processing unit. Specifically, an image of the original document placed on a document stand is read by a color CCD via irradiation lamps, mirrors, and lenses in the scanner 4, and data of the image is sent to the image processing unit. The image processing unit processes the data as needed and converts the data into an image signal. The image signal thus converted is sent to the image forming unit 3, and an image is formed on the recording sheet based on the image signal.

Four imaging units 10Y, 10C, 10M, and 10K (hereinafter collectively referred to as imaging units 10) of a specific color, specifically yellow (Y), cyan (C), magenta (M), or black (K), are arranged in parallel in the image forming unit 3. The image forming unit 3 further includes an intermediate transfer belt 21 and a secondary transfer roller 23. A configuration of the imaging unit 10Y is described in detail below as an example of the imaging units 10 included in the image forming apparatus 1. The imaging units 10C, 10M, and 10K have the same configuration as that of the imaging unit 10Y, and operate in a similar manner as the imaging unit 10Y does, unless otherwise noted.

It is to be noted that each of the imaging units 10 can be used as a process cartridge 100 detachably attachable to the image forming apparatus 1. The process cartridge 100 is described in detail later.

When image formation is started, a charger 12 evenly charges a surface of a photoconductor 11 serving as an electrostatic latent image bearing member in the imaging unit 10Y. An electrostatic latent image of a color of yellow in a full-color image is formed on the charged surface of the photoconductor 11 by a light beam emitted from an irradiating device 30 serving as an optical writing device. Thereafter, the electrostatic latent image of yellow is formed into a visible toner image with yellow toner by the developing device 13. The above-described image formation is similarly performed in the imaging units 10C, 10M, and 10K at predetermined time intervals to form a toner image of a color of cyan, magenta, or black on the respective photoconductors 11. A primary transfer roller 14 is provided opposite each of the photoconductors 11 with the intermediate transfer belt 21 therebetween. A predetermined transfer bias is applied to each of the primary transfer rollers 14 so that the toner images of each color formed on the photoconductors 11 are serially transferred and superimposed on one another onto the intermediate transfer belt 21 to form a full-color toner image.

After the toner images of each color formed on the photoconductors 11 are transferred onto the intermediate transfer belt 21 as described above, the surface potentials of the photoconductors 11 are neutralized by optical neutralizing units, not shown, and residual toner particles on the photoconductors 11 are removed by cleaning devices 15 using a cleaning blade. The toner particles thus removed by the cleaning devices 15 are conveyed to a waste toner container via waste toner conveyance paths. Thereafter, the chargers 12 charge the surfaces of each of the photoconductors 11 to start a series of image forming processes described above.

The charger 12 adopts a contact-type charging method, in which a charging member disposed opposite the photoconductor 11 contacts the photoconductor 11 to evenly charge the surface of the photoconductor 11 by applying a predetermined direct-current voltage to the photoconductor 11. The charging member includes an elastic resin roller. A contactless potential sensor is provided at a portion opposite the surface of the photoconductor 11 between the irradiating device 30 and the developing device 13 relative to a direction of rotation of the photoconductor 11. The contactless potential sensor adjusts amounts of charging bias and light exposure to give the surface of the photoconductor 11 predetermined charging and latent potentials.

The full-color toner image formed on the intermediate transfer belt 21 as described above is transferred onto a recording sheet. Thereafter, toner particles and attached substances such as paper dust remaining on the surface of the intermediate transfer belt 21 are removed by a cleaning brush roller and a cleaning blade, both not shown, in a belt cleaning device 22. The toner particles and the attached substances thus removed are conveyed to the waste toner container in the same manner as the toner particles removed from the surface of the photoconductor 11.

The intermediate transfer belt 21, a counter roller 21*a* provided opposite the secondary transfer roller 23, a transfer bias power source, not shown, a belt drive shaft, not shown, and tension rollers 21*b* and 21*c* are provided in a transfer unit 20. The tension rollers 21*b* and 21*c* apply/release tension to/from the intermediate transfer belt 21 using a cam mechanism, not shown, to cause the intermediate transfer belt 21 to contact or separate from the photoconductors 11. Accordingly, when image formation is started, the intermediate transfer belt 21 contacts the photoconductors 11 before the photoconductors 11 start to rotate. By contrast, when image formation is not performed, the intermediate transfer belt 21 is separated from the photoconductors 11. As described above, after the toner images of each color formed on the photoconductors 11 are transferred onto the intermediate transfer belt 21, the surfaces of the photoconductors 11 are neutralized by the optical neutralizing units. Thereafter, in the cleaning device 15, a brush roller provided upstream relative to a direction of rotation of the photoconductor 11 is contacted to the surface of the photoconductor 11 and rotated in a direction opposite to the direction of rotation of the photoconductor 11 to scratch toner particles and attached substances remaining on the photoconductor 11 and weaken adhesion of the toner particles and the attached substances to the surface of the photoconductor 11. Subsequently, the cleaning blade including an elastic body, provided downstream from the brush roller relative to the direction of rotation of the photoconductor 11, is contacted against the surface of the photoconductor 11 to remove the toner particles and the attached substances.

The full-color toner image formed on the intermediate transfer belt 21 is transferred onto the recording sheet conveyed between the intermediate transfer belt 21 and the secondary transfer roller 23 to which a predetermined bias is applied. The primary transfer rollers 14, the secondary transfer roller 23, and the belt cleaning device 22 are also provided in the transfer unit 20.

The recording sheet selected under control of the image forming apparatus 1 is fed from one of multiple paper feed cassettes 40 of a paper feeder 2 by a pickup roller 42, and conveyed to the image forming unit 3 by a conveyance roller 43. Subsequently, the recording sheet is conveyed to the secondary transfer roller 23 in synchronization with the full-color toner image formed on the intermediate transfer belt 21 by a registration roller 44.

The recording sheet having the full-color toner image thereon is conveyed to a fixing device 31. In the fixing device 31, heat and pressure are applied to the recording sheet to fix the full-color toner image on the recording sheet. The recording sheet to which the full-color toner image is fixed is then discharged from the image forming apparatus 1.

Figure 4:
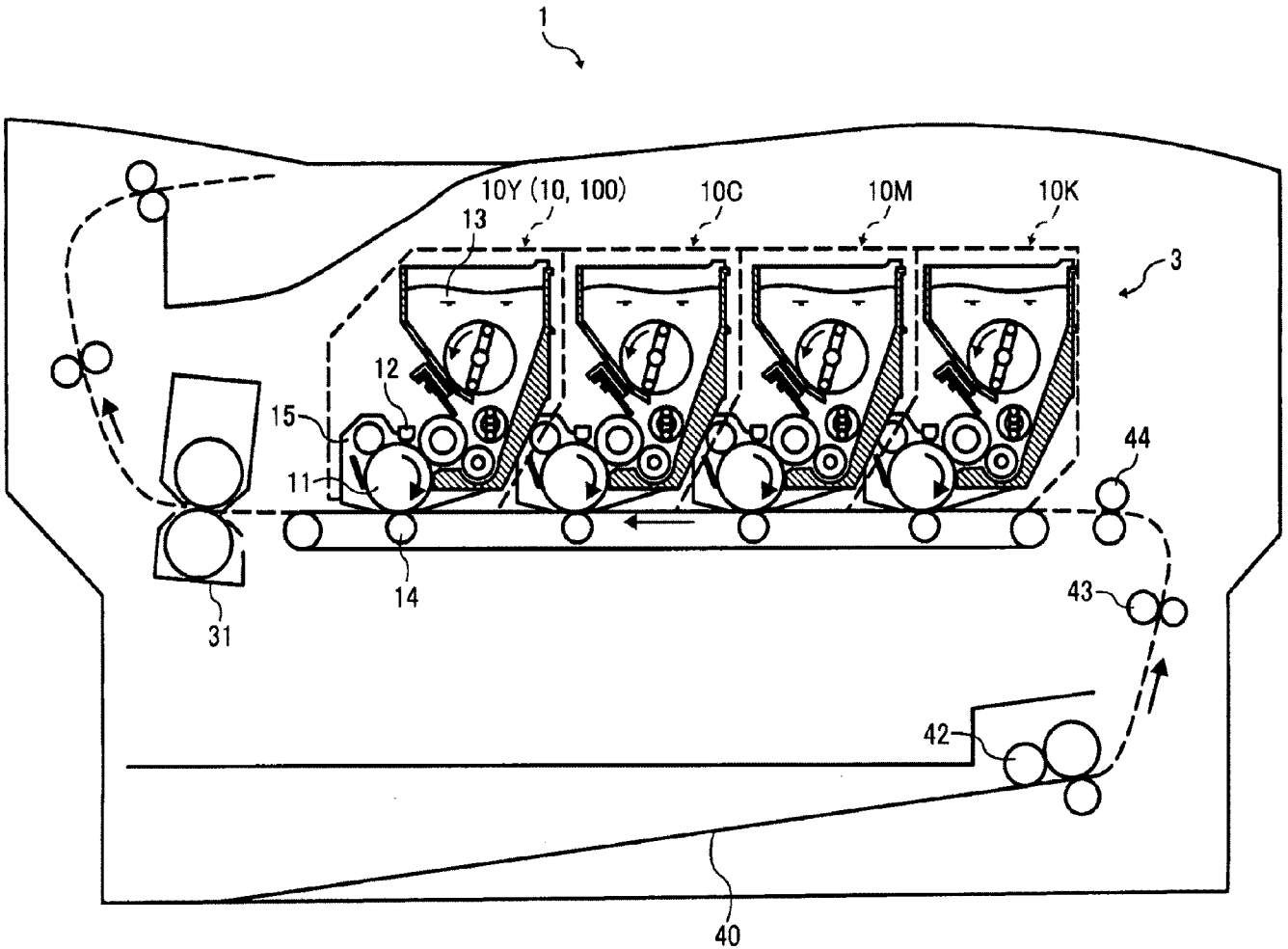
FIG. 4 is a schematic view illustrating another example of the image forming apparatus including the developing device.

FIG. 4 is a schematic view illustrating another example of the image forming apparatus 1 employing the developing device 13. Unlike the image forming apparatus 1 illustrated in FIG. 3, the image forming apparatus 1 illustrated in FIG. 4 does not include the intermediate transfer belt 21, and the toner images formed on each of the photoconductors 11 are directly superimposed on the recording sheet while the recording sheet passes between the photoconductors 11 and the primary transfer rollers 14. Thereafter, the recording sheet having the full-color toner image thereon is conveyed to the fixing device 31, and heat and pressure is applied to the recording sheet to fix the full-color toner image on the recording sheet. The recording sheet having the full-color image thereon is then discharged from the image forming apparatus 1 in a similar manner as the case illustrated in FIG. 3.

Figure 5:
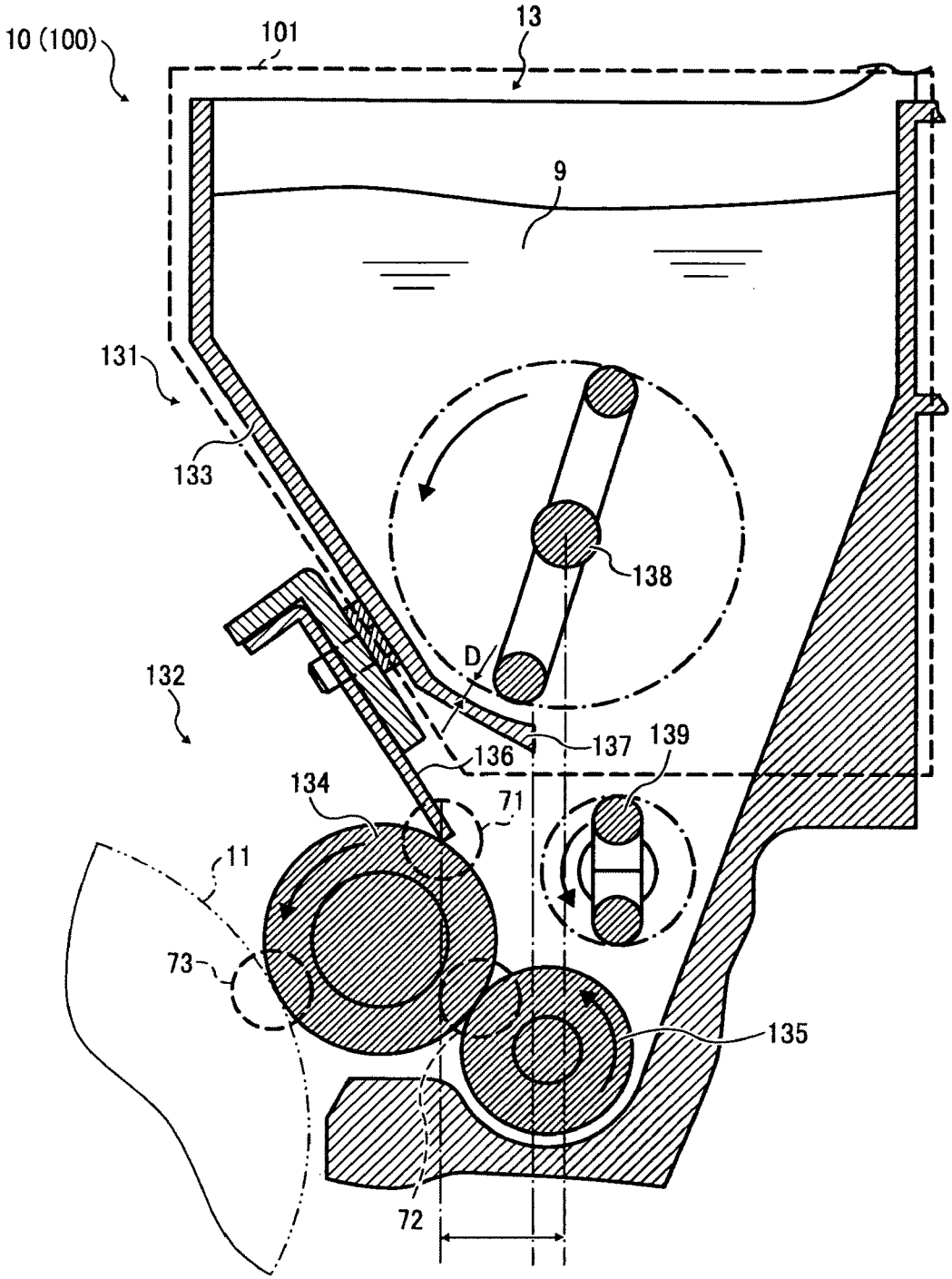
FIG. 5 is a schematic view illustrating an example of the developing device.

FIG. 5 is a schematic view illustrating an example of the developing device 13. The developing device 13 mainly includes a toner container 131 storing a developer, and a developing unit 132 disposed facing the photoconductor 11 to develop the electrostatic latent image formed on the photoconductor 11 with the developer.

The toner container 131 is disposed above the developing unit 132, and contains toner 9 serving as the developer. The toner container 131 includes a first agitation roller 138 serving as a developer agitation member.

It should be noted that the developing device 13 uses the toner 9 as a one-component developer. Either magnetic toner or non-magnetic toner may be used as the one-component developer. The developing device 13 is configured to smoothly convey the toner 9 without using a carrier serving as an agitation and mixing medium, and prevent stress to the toner 9 and accumulation of the toner 9 in the developing device 13.

The toner container 131 further includes a guide member 137 serving as a developer guide member. In order to prevent a rapid change in an amount of charge of the toner 9 supplied to a developing roller 134, the guide member 137 is configured to prevent the toner 9 from being directly supplied to a restriction nip 71 formed between the developing roller 134 and a restriction member 136. In the toner container 131, the first agitation roller 138 is rotated such that the toner 9 is smoothly conveyed from the toner container 131 to the developing unit 132 without causing accumulation of the toner 9 in the toner container 131. The first agitation roller 138 is configured to agitate the toner 9 to prevent aggregation of the toner 9 in the toner container 131 and sufficiently charge the toner 9.

The developing unit 132 is disposed below the toner container 131. The developing unit 132 includes the developing roller 134, the restriction member 136, and a toner supply roller 135. The developing roller 134 serving as a developer bearing member is rotatably provided in the developing unit 132. The restriction member 136 is configured to press the developing roller 134 to restrict the amount of toner 9 supplied to the developing roller 134. The toner supply roller 135 serving as a developer supply member is rotatably provided, and contacts the developing roller 134. It should be noted that the toner container 131 is disposed above the toner supply roller 135.

The toner 9 stored in the toner container 131 is conveyed to the toner supply roller 135. The toner supply roller 135 is rotated while bearing the toner 9 to convey the toner 9 to a supply nip 72 formed between the developing roller 134 and the toner supply roller 135. The developing roller 134 and the toner supply roller 135 are rotated in opposite directions at the supply nip 72 to press the toner 9 and charge the toner 9. The toner 9 thus charged is borne by the developing roller 134 and conveyed to the restriction member 136.

At the restriction nip 71 formed between the developing roller 134 and the restriction member 136, the restriction member 136 restricts the amount of the toner 9 supplied to a developing nip 73 formed between the developing roller 134 and the photoconductor 11. The amount of the toner 9 conveyed by the developing roller 134 to the developing nip 73 changes depending on the amount of the toner 9 supplied to the restriction nip 71. Therefore, the change in the amount of the toner 9 conveyed to the developing nip 73 can be decreased by stabilizing the amount of the toner 9 supplied to the restriction nip 71, thereby reliably providing higher-quality images.

The developing unit 132 may further include a second agitation roller 139 serving as a second agitation member, configured to smoothly convey the toner 9 supplied from the toner container 131 to the toner supply roller 135. The second agitation roller 139 is disposed at a portion where the toner 9 passes when supplied to the developing unit 132 from the toner container 131 so that a constant amount of the toner 9 can be supplied to the developing unit 132.

The guide member 137 is configured to guide the toner 9 to the developing unit 132 from the toner container 131. More specifically, the guide member 137 is configured to guide the toner 9 to the toner supply roller 135 to prevent a larger amount of the toner 9 from being directly supplied to the supply nip 72 formed between the developing roller 134 and the toner supply roller 135. As described above, the guide member 137 is included in the toner container 131, and has a shape along a rotation path of the first agitation roller 138.

Figure 6A:
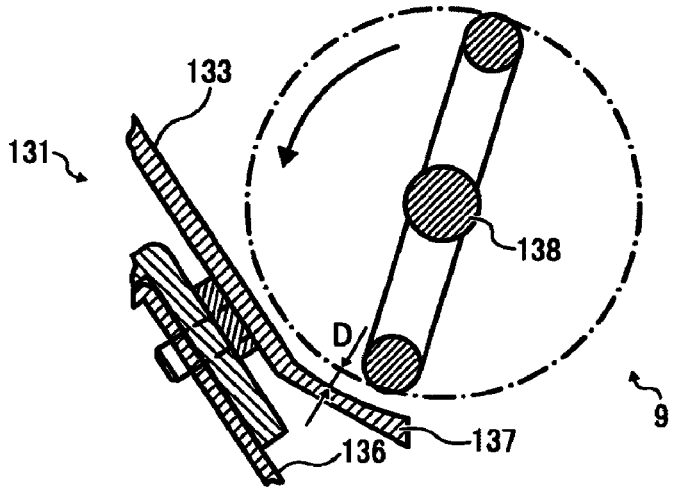
FIG. 6A is a schematic view illustrating an example of a first agitation roller and a guide member included in the developing device.

FIG. 6A is a schematic view illustrating an example of the first agitation roller 138 and the guide member 137. Referring to FIG. 6A, a part of a housing 133 of the developing device 13 is formed in an arc shape along the rotation path of the first agitation roller 138 in the toner container 131 and serves as the guide member 137.

A distance D between the guide member 137 and the rotation path of the first agitation roller 138 is set not greater than 5 mm so as to agitate the toner 9 flow. This distance stems from the fact that, when the toner 9 having lower fluidity was agitated by the first agitation roller 138 having a round bar shape, it was confirmed that the flow of the toner 9 observed above the developing device 13 was influenced by agitation of the first agitation roller 138 at positions 5 mm or less apart from the rotation path of the first agitation roller 138.

Figure 6B:
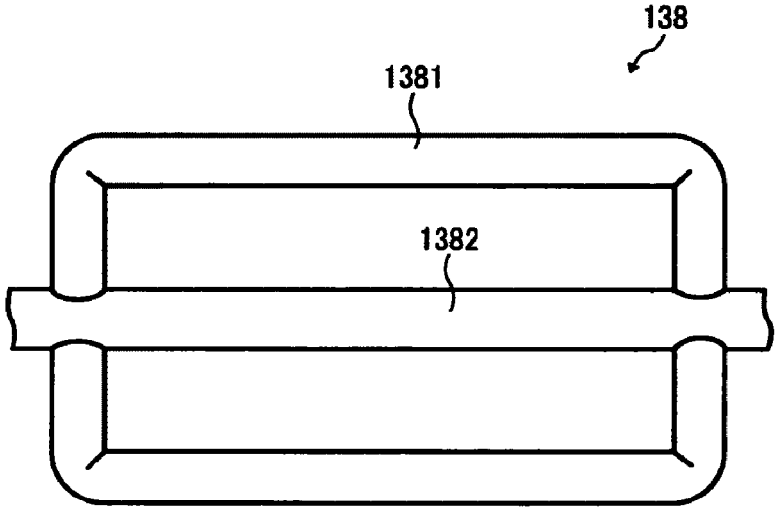
FIG. 6B is an enlarged schematic view illustrating the first agitation roller illustrated in FIG. 6A.
Figure 6C:
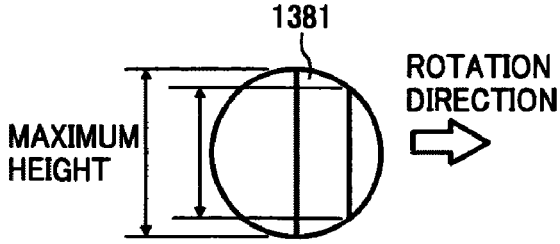
FIG. 6C is a cross-sectional view illustrating a rectangular frame of the first agitation roller illustrated in FIG. 6A.

FIG. 6B is an enlarged schematic view illustrating the first agitation roller 138 illustrated in lateral cross section in FIG. 6A. Referring to FIG. 6B, the first agitation roller 138 includes a rectangular frame 1381 and a rotation shaft 1382. The rotation shaft 1382 is provided at the center of the rectangular frame 1381 in a longitudinal direction thereof. A cross section of the rectangular frame 1381 has a circular shape as illustrated in FIG. 6C. Accordingly, the cross section of the rectangular frame 1381 becomes wider from an upstream side to a downstream side relative to the direction of rotation of the first agitation roller 138, thereby reducing resistance to the toner 9 caused by rotation of the first agitation roller 138. Further, such a rectangular frame 1381 line-contacts the toner 9, in other words, point-contacts the toner 9 in a cross-sectional view. Accordingly, the first agitation roller 138 has a leading edge in the direction of rotation thereof. As a result, the first agitation roller 138 agitates the toner 9 without causing stress to the toner 9, thereby preventing deterioration of the toner 9.

As described above, in order to prevent accumulation of the toner 9 in the toner container 131, the guide member 137 is shaped along the rotation path of the first agitation roller 138 so that the toner 9 is smoothly conveyed from the toner container 131 to the developing unit 132.

Specifically, a height of the cross section of the rectangular frame 1381 in a shaft direction is gradually reduced from the maximum height thereof relative to the direction of rotation of the first agitation roller 138, thereby reducing resistance to the toner 9. More specifically, referring to FIG. 6C, the height of the cross section of the rectangular frame 1381 is gradually reduced from the maximum height thereof, which is identical to a diameter of the cross section of the rectangular frame 1381, relative to the direction of rotation of the first agitation roller 138. The height of the cross section of the rectangular frame 1381 in the shaft direction may be identical to the maximum height, or gradually reduced, relative to a direction opposite to the direction of rotation of the first agitation roller 138. Alternatively, the cross section of the rectangular frame 1381 may have a semicircular shape cut along the maximum height thereof. As described above, the first agitation roller 138 preferably has a leading edge in the direction of rotation thereof.

Figure 7A:
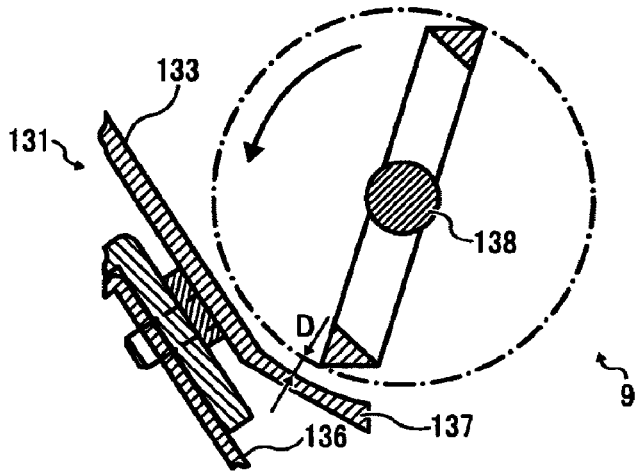
FIG. 7A is a schematic view illustrating another example of the first agitation roller and the guide member included in the developing device.
Figure 7B:
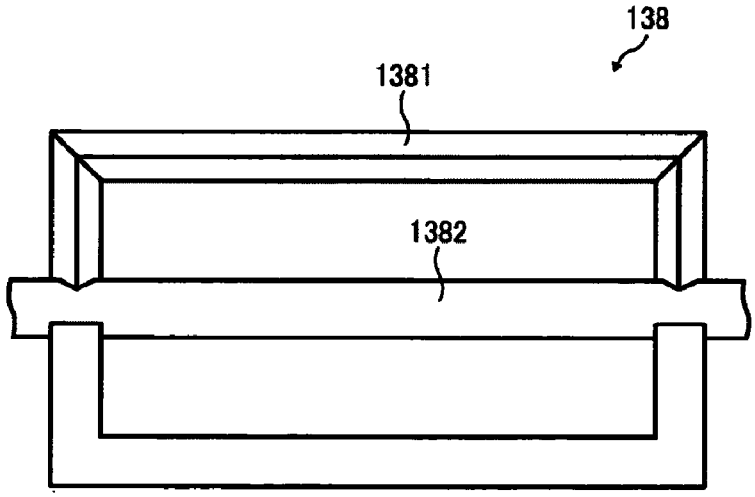
FIG. 7B is an enlarged schematic view illustrating the first agitation roller illustrated in FIG. 7A.
Figure 7C:
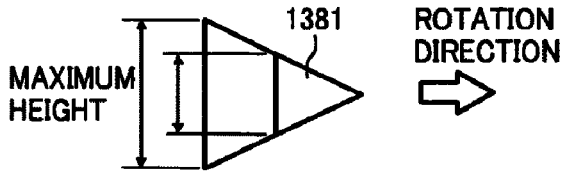
FIG. 7C is a cross-sectional view illustrating a rectangular frame of the first agitation roller illustrated in FIG. 7A.

FIG. 7A is a schematic view illustrating another example of the first agitation roller 138 and the guide member 137. FIG. 7B is an enlarged schematic view illustrating the first agitation roller 138 illustrated in FIG. 7A. FIG. 7C is a cross-sectional view illustrating the rectangular frame 1381 of the first agitation roller 138 illustrated in FIG. 7B.

As illustrated in FIG. 7C, the cross section of the rectangular frame 1381 may be triangular. In a similar manner as the rectangular frame 1381 illustrated in FIGS. 6A to 6C, the height of the cross section of the rectangular frame 1381 illustrated in FIGS. 7A to 7C is also gradually reduced from the maximum height thereof relative to the direction of rotation of the first agitation roller 138, thereby reducing resistance to the toner 9. Further, the guide member 137 disposed in the toner container 131 is shaped into an arc to keep the distance D from the rotation path of the first agitation roller 138. The rectangular frame 1381 having the triangular cross section as described above has a more reliable leading edge in the direction of rotation of the first agitation roller 138 compared with the rectangular frame 1381 having the circular cross section, thereby further reducing resistance to the toner 9. Therefore, the toner 9 is loosen rather than agitated by the first agitation roller 138 illustrated in FIG. 7A. After loosening by the first agitation roller 138, the toner 9 flows downward to the developing unit 132 under its own weight. As a result, less stress is applied to the toner 9, and deterioration of the toner 9 is prevented.

Figure 8A:
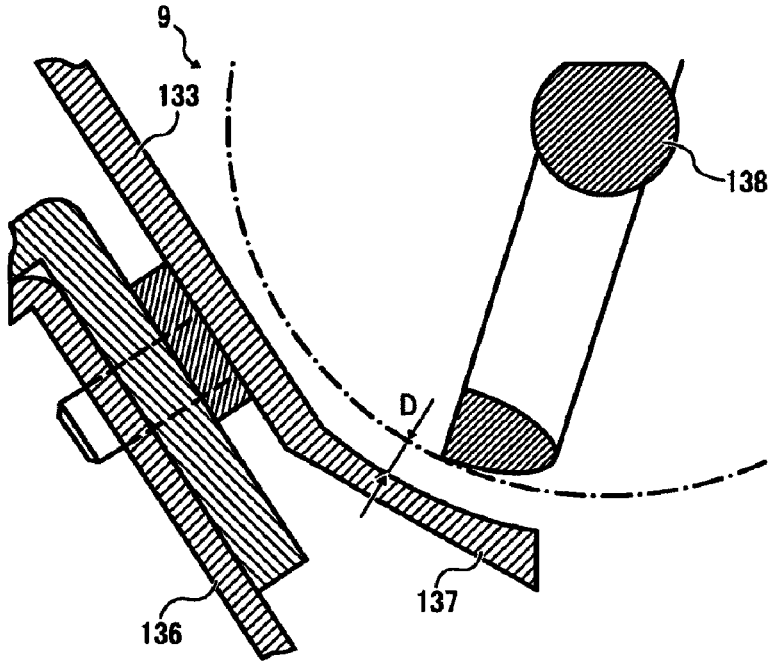
FIGS. 8A and 8B are schematic views illustrating yet other examples of the first agitation roller and the guide member included in the developing device, respectively.
Figure 8B:
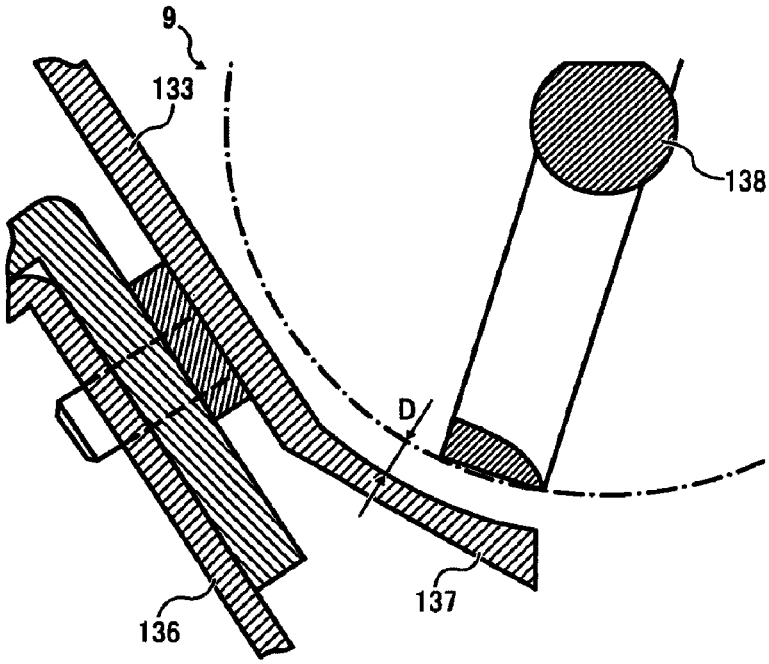

FIGS. 8A and 8B are schematic views illustrating yet other examples of the first agitation roller 138 and the guide member 137, respectively.

Referring to FIG. 8A, the cross section of the first agitation roller 138 is shaped into a semi-ellipse or a semi-circle. Accordingly, the cross section of the first agitation roller 138 becomes wider from the upstream side to the downstream side relative to the direction of rotation of the first agitation roller 138, thereby reducing resistance to the toner 9 caused by rotation of the first agitation roller 138. Alternatively, referring to FIG. 8B, the cross section of the first agitation roller 138 is shaped into a quarter-ellipse or a quarter-circle. Therefore, the cross section of the first agitation roller 138 becomes wider from the upstream side to the downstream side relative to the direction of rotation of the first agitation roller 138, thereby reducing resistance to the toner 9 caused by rotation of the first agitation roller 138.

As described above, the first agitation roller 138 having such a cross section line-contacts the toner 9 and has a leading edge in the direction of rotation thereof. Accordingly, the first agitation roller 138 illustrated in FIGS. 8A and 8B agitates the toner 9 without causing stress to the toner 9, thereby preventing deterioration of the toner 9. Further, in order to prevent accumulation of the toner 9 in the toner container 131, the guide member 137 is formed along the rotation path of the first agitation roller 138 so that the toner 9 is smoothly conveyed from the toner container 131 to the developing unit 132.

Referring back to FIG. 5, in the developing device 13, the restriction nip 71, the edge of the guide member 137, and the center of rotation of the first agitation roller 138 are arranged in that order in a horizontal direction.

In order to prevent the toner 9 from being directly supplied to the restriction nip 71 from the toner container 131, the edge of the guide member 137 is extended from the toner container 131 to cover the restriction nip 71 from above. Accordingly, as described above, the restriction nip 71, the edge of the guide member 137, and the center of rotation of the first agitation roller 138 are arranged in that order in the horizontal direction.

Figure 9A:
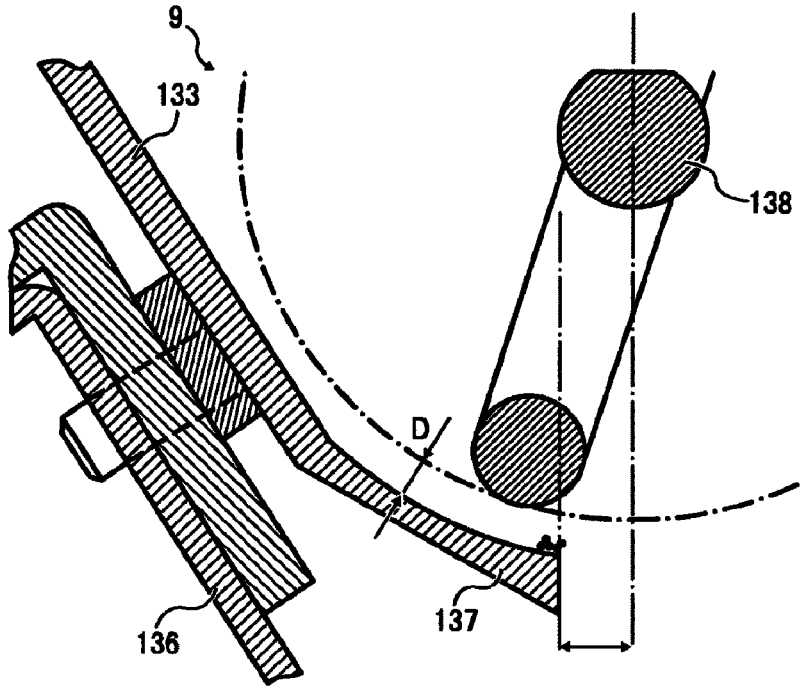
FIG. 9A is an enlarged schematic view illustrating a case in which an edge of the guide member does not extend horizontally to a hypothetical line extending vertically downward from a center of rotation of the first agitation roller.
Figure 9B:
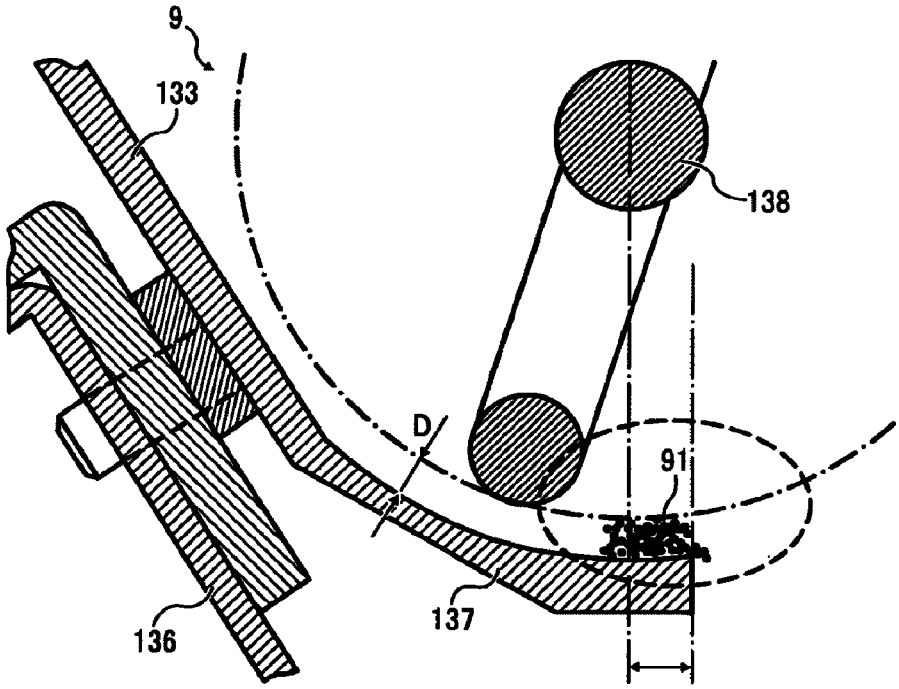
FIG. 9B is an enlarged schematic view illustrating a case in which the edge of the guide member is extended horizontally beyond a hypothetical line extending vertically downward from the center of rotation of the first agitation roller.

FIG. 9A is an enlarged schematic view illustrating a case in which the edge of the guide member 137 does not extend horizontally to a hypothetical line extending vertically downward from the center of rotation of the first agitation roller 138. By contrast, FIG. 9B is an enlarged schematic view illustrating a case in which the edge of the guide member 137 is extended horizontally beyond a hypothetical line extending vertically downward from the center of rotation of the first agitation roller 138.

Referring to FIG. 9A, the edge of the guide member 137 is not extended below the center of rotation of the first agitation roller 138, so that the toner 9 agitated and conveyed by the first agitation roller 138 is easily supplied to the developing unit 132. As a result, accumulation of the toner 9 on the guide member 137 can be reduced, and stress applied to the toner 9 can be reduced.

By contrast, referring to FIG. 9B, the edge of the guide member 137 is extended beyond a point directly below the center of rotation of the first agitation roller 138. Consequently, the toner 9 conveyed to a portion indicated by a broken line in FIG. 9B tends to remain at that portion, possibly resulting in toner accumulation 91. Further, because it may take a longer time to convey the toner 9 to the developing unit 132, greater stress may be applied to the toner 9, possibly causing deterioration of the toner 9.

To solve such problems, the restriction nip 71, the edge of the guide member 137, and the center of rotation of the first agitation roller 138 are arranged in that order in the horizontal direction, so that direct supply of the toner 9 to the restriction nip 71 which may cause improper images is prevented. In addition, the toner accumulation 91 in the toner container 131 is prevented, thereby reducing stress to the toner 9 and preventing deterioration of the toner 9.

Figure 10:
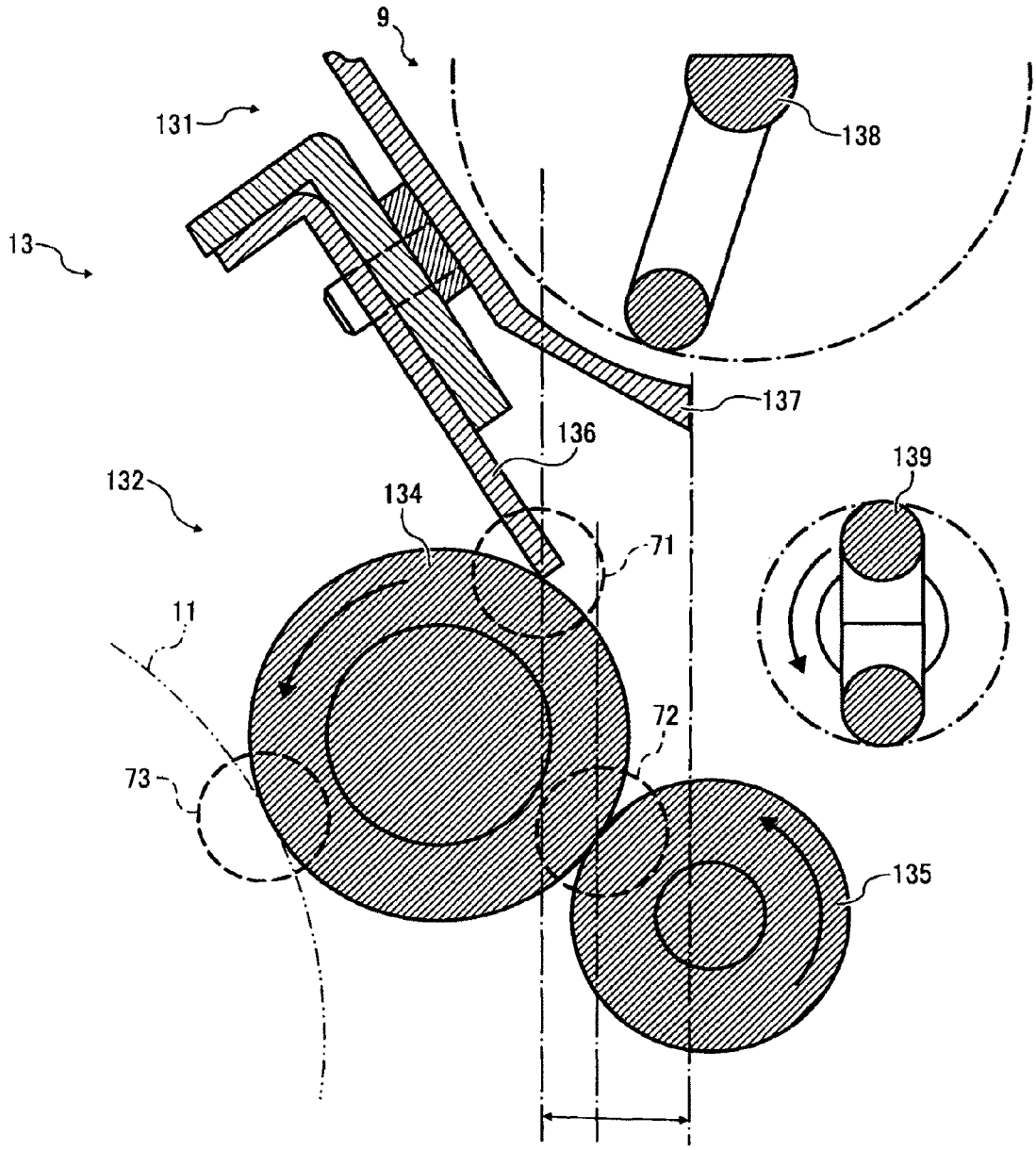
FIG. 10 is a schematic view illustrating relative positions of a supply nip, a restriction nip, and the edge of the guide member in the developing device.

Further, referring to FIG. 10, in the developing device 13, the supply nip 72 formed between the developing roller 134 and the toner supply roller 135 is arranged between the restriction nip 71 and the edge of the guide member 137 in the horizontal direction.

FIG. 10 is a schematic view illustrating relative positions of the supply nip 72, the restriction nip 71, and the edge of the guide member 137 in the developing device 13.

The toner 9 is supplied from the toner supply roller 135 to the developing roller 134 at the supply nip 72. However, when a larger amount of the toner 9 is directly supplied to the supply nip 72 from the toner container 131, the toner 9 which is not sufficiently charged is supplied to the developing roller 134. Consequently, when the electrostatic latent image formed on the photoconductor 11 is developed with the above-described insufficiently-charged toner 9 at the developing nip 73 formed between the developing roller 134 and the photoconductor 11, improper images including background fogging may be formed. To prevent such a problem, the supply nip 72 is arranged between the restriction nip 71 and the edge of the guide member 137 so that higher-quality images are reliably formed.

As described above, referring back to FIG. 5, the guide member 137 is integrally formed as a part of the housing 133 of the developing device 13, thereby simplifying the configuration of the developing device 13. Alternatively, the guide member 137 may be formed as described below.

Figure 11A:
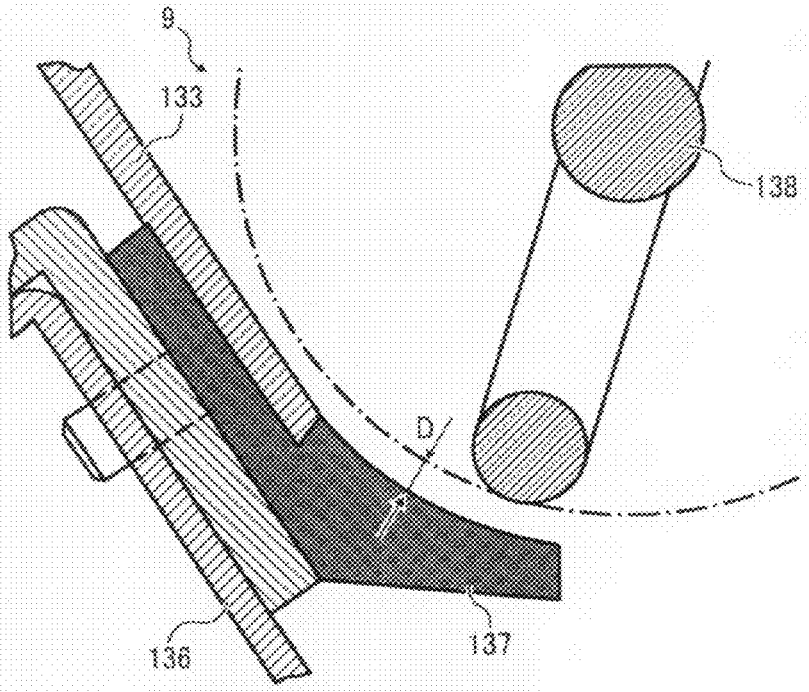
FIGS. 11A and 11B are enlarged schematic views illustrating other examples of the guide member included in the developing device, respectively.
Figure 11B:
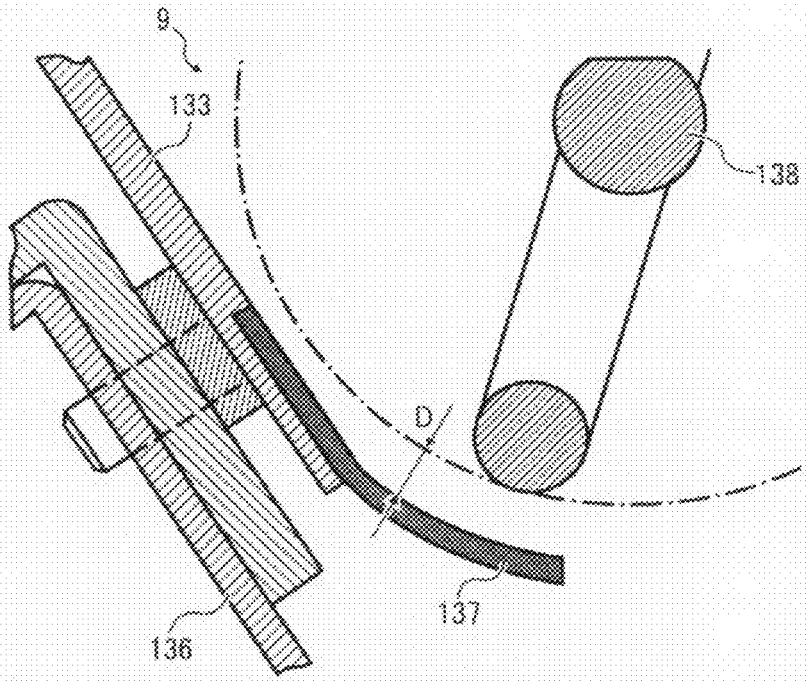

FIGS. 11A and 11B are enlarged schematic views illustrating other examples of the guide member 137 included in the developing device 13, respectively. Referring to FIG. 11A, the guide member 137 is disposed between the housing 133 and the restriction member 136. The guide member 137 is smoothly connected to the housing 133 to eliminate unevenness on an inner surface of the toner container 131, thereby preventing accumulation of the toner 9. Alternatively, referring to FIG. 11B, the guide member 137 including a metal plate is bonded to an inner surface of the housing 133 with an adhesive agent such as double-sided tape. In such a case, however, unevenness may arise on the inner surface of the toner container 131 depending on a thickness of the guide member 137, possibly causing accumulation of the toner 9. Therefore, in order to prevent accumulation of the toner 9, it is preferable that the guide member 137 be smoothly bonded to the inner surface of the housing 133 without causing unevenness on the inner surface of the toner container 131.

It should be noted that the guide member 137 is preferably made of a material of such rigidity that it is not easily deformed, such as a rigid resin or metal, so that the distance D between the first agitation roller 138 and the guide member 137 is maintained reliably.

Figure 12:
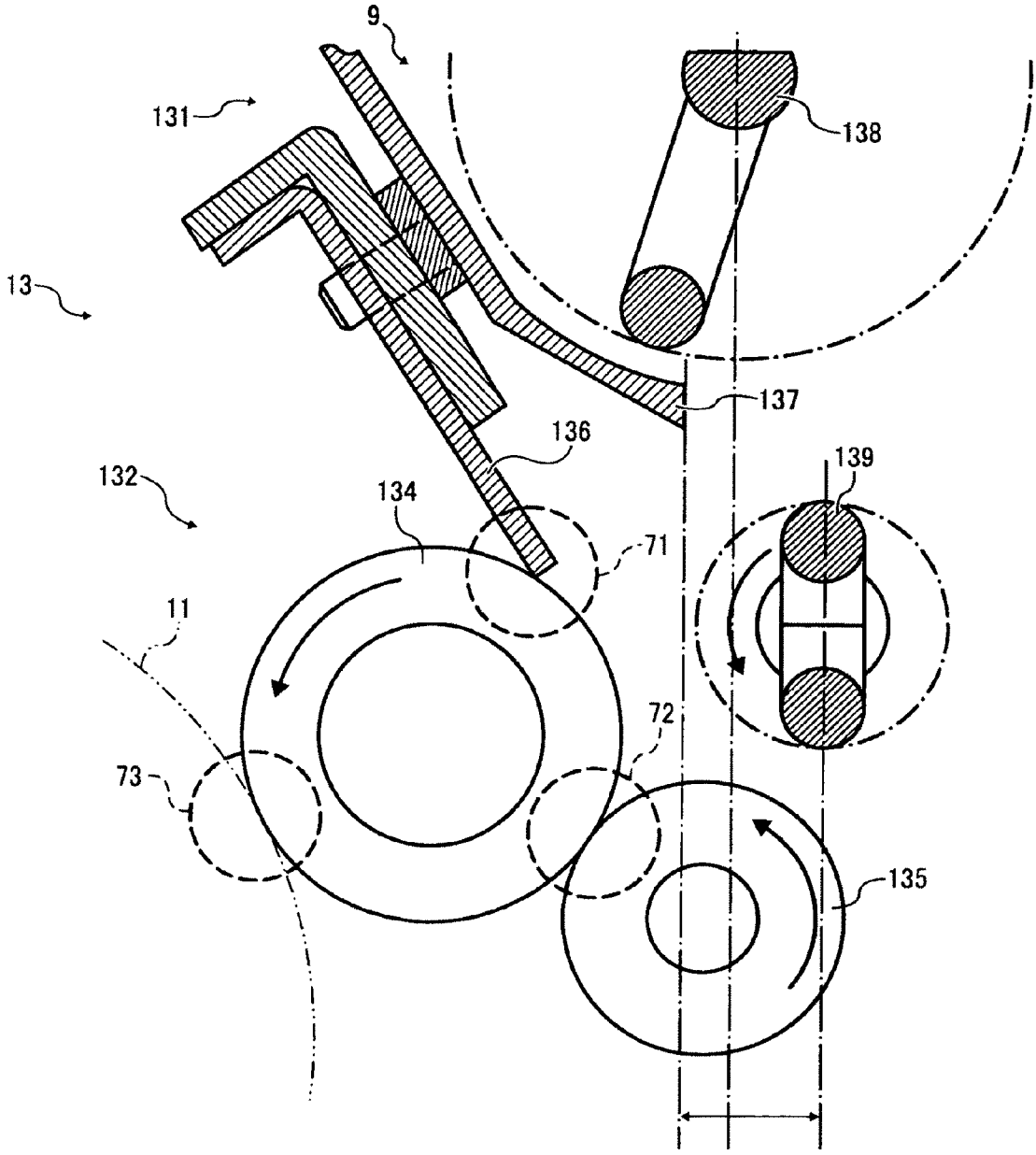
FIG. 12 is a schematic view illustrating relative positions of the edge of the guide member, the center of rotation of the first agitation roller, and a center of rotation of a second agitation roller.

FIG. 12 is a schematic view illustrating relative positions of the edge of the guide member 137, the center of rotation of the first agitation roller 138, and the center of rotation of the second agitation roller 139 in the developing device 13. As described above, the developing unit 132 includes the second agitation roller 139 above the toner supply roller 135. Referring to FIG. 12, the edge of the guide member 137, the center of rotation of the first agitation roller 138, and the center of rotation of the second agitation roller 139 are arranged in that order in the horizontal direction.

The toner 9 is supplied to the developing unit 132 from the toner container 131 along the guide member 137 due to rotation of the first agitation roller 138. A radius of rotation of the second agitation roller 139 is set smaller than that of the first agitation roller 138 due to limited space in the developing unit 132. However, there is no need to increase the radius of rotation of the second agitation roller 139 because the second agitation roller 139 has only to make the toner 9 supplied above from the toner container 131 be sufficiently agitated and smoothly conveyed to the toner supply roller 135.

The center of rotation of the second agitation-roller 139 is located further from the developing roller 134 than the center of rotation of the first agitation roller 138 in the horizontal direction. The toner supply roller 135 is pressed against the developing roller 134 so that the toner 9 is frictionally charged and supplied from the toner supply roller 135 to the developing roller 134. Therefore, when the second agitation roller 139 is located too close to the developing roller 134, the toner 9 is directly supplied to the developing roller 134 from the second agitation roller 139. Specifically, the toner 9 which is not sufficiently charged is supplied to the developing roller 134.

To solve such a problem, as illustrated in FIG. 12, the developing roller 134, the center of rotation of the first agitation roller 138, and the center of rotation of the second agitation roller 139 are arranged in that order in the horizontal direction. As a result, the toner 9 is first supplied to the toner supply roller 135, and then supplied to the developing roller 134. In order to properly supply the toner 9 to the toner supply roller 135 first, it is preferable that a rotation path of the second agitation roller 139 does not reach above the supply nip 72.

A description is now given of a toner cartridge 101 according to illustrative embodiments.

Referring back to FIG. 5, the toner cartridge 101 is configured to store the toner 9 to be supplied to the developing roller 134 disposed facing the photoconductor 11. The toner cartridge 101 includes the toner container 131, and is detachably attached to the developing device 13.

Figure 13A:
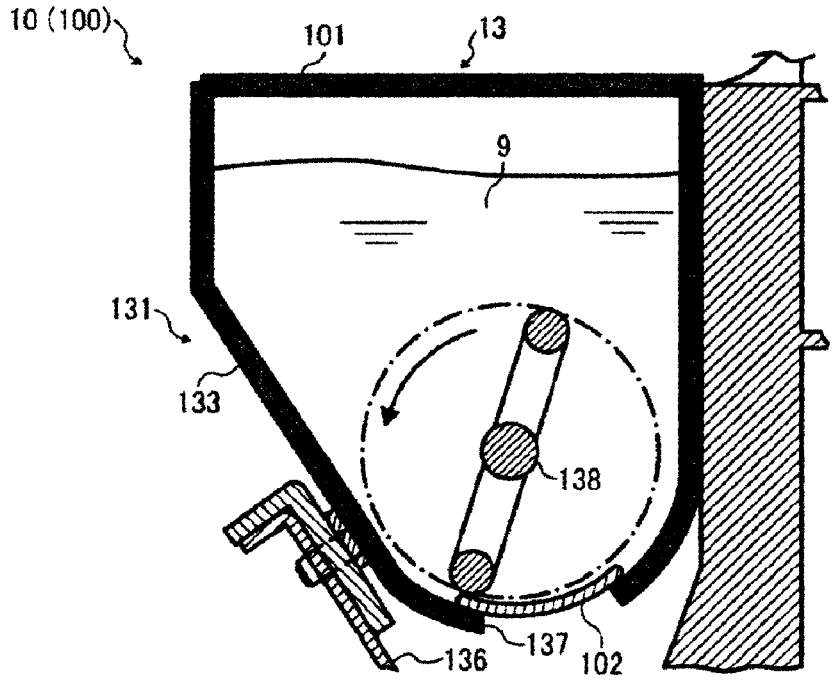
FIGS. 13A and 13B are schematic views illustrating examples of a toner cartridge according to respective illustrative embodiments.
Figure 13B:
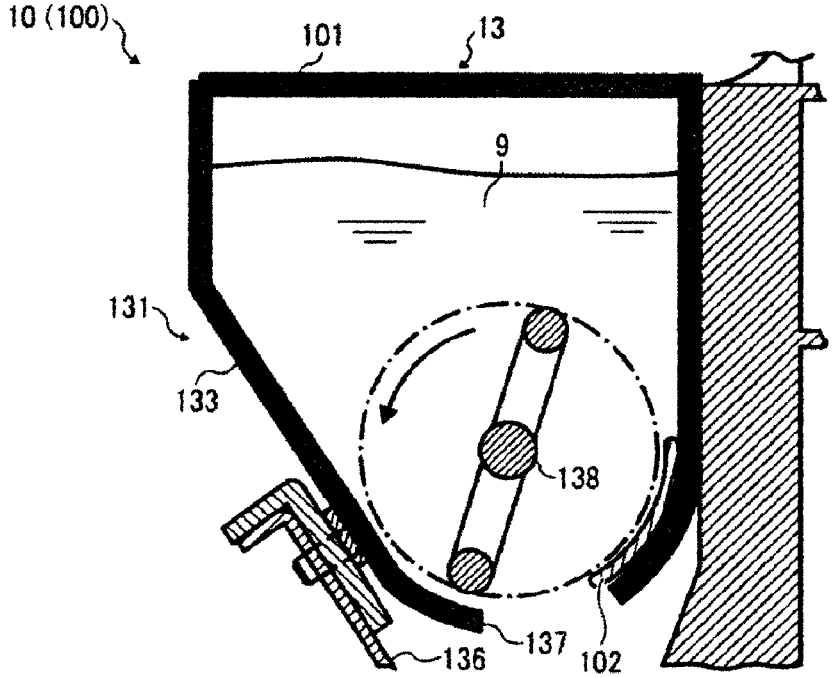

FIGS. 13A and 13B are schematic views illustrating respective examples of the toner cartridge 101.

Referring to FIG. 13A, a slide shutter 102 is provided at a connection portion of the developing unit 132 and the toner cartridge 101. The slide shutter 102 is closed when the toner cartridge 101 is detached from the developing device 13. Specifically, the slide shutter 102 is closed when the toner cartridge 101 is detached from the developing device 13 to be replaced with a new one, thereby preventing the toner 9 from spilling outside of the toner cartridge 101. By contrast, the slide shutter 102 is opened during image formation to supply the toner 9 to the developing-unit 132.

As described above, the process cartridge 100, also referred to as the imaging unit 10 herein, includes at least the photoconductor 11 and the developing device 13, and may include other process devices such as the charger 12, the cleaning device 15, and a lubricant agent applicator. The process cartridge 100 is detachably attached to the image forming apparatus 1. The process cartridge 100 illustrated in FIG. 3 includes the photoconductor 11, the charger 12, the developing device 13 including the toner cartridge 101, and the cleaning device 15. As a result, for example, the photoconductor 11 can be easily replaced with a new one, thereby facilitating maintenance.

A description is now given of the toner 9 according to illustrative embodiments.

The toner 9 preferably has a volume average particle diameter (Dv) of from 3 to 8 μm to reproduce microdots not less than 600 dpi. Toner having a smaller particle diameter has an advantage in terms of producing high definition and high quality images. When the volume average particle diameter is too small, transferability of the toner and blade cleanability deteriorate. By contrast, when the volume average particle diameter is too large, it is difficult to accurately reproduce characters and lines. The toner 9 preferably has a ratio (Dv/Dn) of the volume average particle diameter (Dv) to the number average particle diameter (Dn) of from 1.00 to 1.40. As the ratio (Dv/Dn) approaches 1, the particle diameter distribution becomes narrower. Toner having such a small particle diameter and a narrow particle diameter distribution can be uniformly charged and transferred, and therefore high quality images without background fogging can be produced, and a higher transfer rate can be achieved in the electrostatic transfer system.

A description is now given of a method for measuring the particle diameter distribution of the toner 9. For example, the particle diameter distribution of the toner 9 can be measured by the Coulter Counter method using COULTER COUNTER TA-II and COULTER MULTISIZER II, both from Beckman Coulter, Inc. The typical measurement method is described below.

First, 0.1 to 5 ml of a surfactant (preferably an alkylbenzene sulfonate) is added as a dispersant to 100 to 150 ml of an electrolyte. Here, an approximately 1% by mass aqueous solution of NaCl prepared by using first grade sodium chloride such as ISOTON-II manufactured by Beckman Coulter, Inc. can be used as the electrolyte. Next, 2 to 20 mg of a toner sample is further added to the electrolyte and dispersed using an ultrasonic dispersing machine for about 1 to 3 minutes to prepare a toner suspension liquid. A volume and a number of toner particles are measured by the above-described machine using an aperture of 100 μm to determine volume and number distributions. From the distributions thus obtained, a volume average particle diameter (Dv) and a number average particle diameter (Dn) of the toner 9 are determined.

As channels, for example, the following 13 channels can be used: 2.00 to less than 2.52 μm; 2.52 to less than 3.17 μm; 3.17 to less than 4.00 μm; 4.00 to less than 5.04 μm; 5.04 to less than 6.35 μm; 6.35 to less than 8.00 μm; 8.00 to less than 10.08 μm; 10.08 to less than 12.70 μm; 12.70 to less than 16.00 μm; 16.00 to less than 20.20 μm; 20.20 to less than 25.40 μm; 25.40 to less than 32.00 μm; and 32.00 to less than 40.30 μm. Specifically, particles having a particle diameter of from not less than 2.00 μm to less than 40.30 μm can be measured.

Figure 14A:
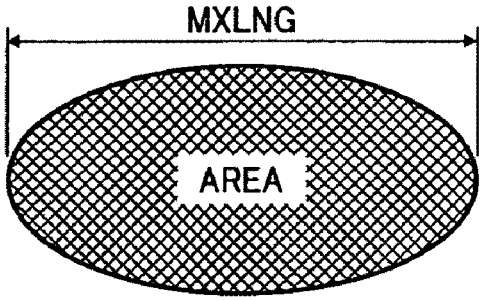
FIGS. 14A and 14B are schematic views illustrating a shape of a toner particle for explaining shape factors SF-1 and SF-2, respectively.
Figure 14B:
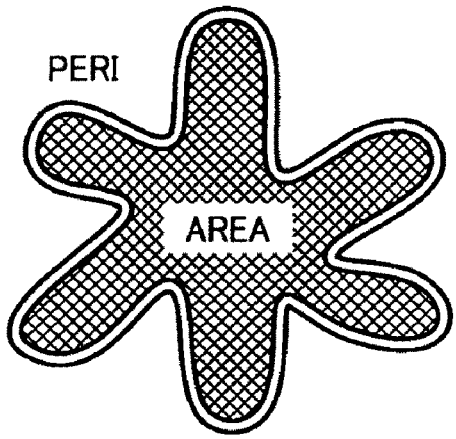

The toner 9 preferably has a shape factor SF-1 of from 100 to 180, and a shape factor SF-2 of from 100 to 180. FIGS. 14A and 14B are schematic views each illustrating the shape of a toner for explaining SF-1 and SF-2, respectively.

The shape factor SF-1 represents a degree of roundness of a toner particle, and is determined in accordance with the following formula (1).

$$SF\text{-}1=\{(MXLNG)^2/\text{AREA}\}\times(100\pi/4) \quad (1)$$

The shape factor SF-1 is obtained by dividing the square of the maximum length MXLNG of the shape produced by projecting the toner particle in a two-dimensional plane, by the figural surface area AREA, and subsequently multiplying by 100π/4. When SF-1 is 100, the toner particle has a shape of a complete sphere. As SF-1 becomes greater, the toner particle becomes more amorphous.

The shape factor SF-2 represents a concavity and convexity of the shape of the toner particle, and is determined in accordance with the following formula (2).

$$SF\text{-}2=\{(PELI)^2/\text{AREA}\}\times(100/4\pi) \quad (2)$$

The shape factor SF-2 is obtained by dividing the square of the perimeter PERI of the figure produced by projecting the toner particle in a two-dimensional plane, by the figural surface area AREA, and subsequently multiplying by 100/4π.

When SF-2 is 100, the surface of the toner particle has no concavities and convexities. As SF-2 becomes greater, the concavities and convexities thereon become more noticeable.

The shape factors can be measured by taking a picture of the toner particle with a scanning electron microscope S-800 manufactured by Hitachi, Ltd., and analyzing the picture with an image analyzer LUSEX 3 manufactured by Nireco Corporation to calculate the shape factors.

When a shape of the toner particle becomes close to a sphere, toner particles contact each other as well as the photoconductor 11 in a point contact manner. Consequently, adsorbability between the toner particles decreases, resulting in an increase in fluidity. Moreover, adsorbability between the toner particles and the photoconductor 11 decreases, resulting in an increase in a transfer rate.

When either the shape factor SF-1 or SF-2 is too large, the transfer rate deteriorates.

The toner 9 preferably used for image formation performed by the image forming apparatus 1 is obtained by a crosslinking reaction and/or an elongation reaction of a toner constituent liquid in an aqueous solvent. Here, the toner constituent liquid is prepared by dispersing a polyester prepolymer including a functional group having at least a nitrogen atom, a polyester, a colorant, and a releasing agent in an organic solvent. A description is now given of toner constituents and a method for manufacturing toner.

(Polyester)

The polyester is prepared by a polycondensation reaction between a polyalcohol compound and a polycarboxylic acid compound. Specific examples of the polyalcohol compound (PO) include a diol (DIO) and a polyol having 3 or more valances (TO). The DIO alone, and a mixture of the DIO and a smaller amount of the TO are preferably used as the PO. Specific examples of the diol (DIO) include alkylene glycols (e.g., ethylene glycol, 1,2-propylene glycol, 1,3-propylene glycol, 1,4-butanediol, and 1,6-hexanediol), alkylene ether glycols (e.g., diethylene glycol, triethylene glycol, dipropyrene glycol, polyethylene glycol, polypropylene glycol, and polytetramethylene ether glycol), alicyclic diols (e.g., 1,4-cyclohexane dimethanol, and hydrogenated bisphenol A), bisphenols (e.g., bisphenol A, bisphenol F, and bisphenol S), alkylene oxide adducts of the above-described alicyclic diols (e.g., ethylene oxide, propylene oxide, and butylene oxide), and alkylene oxide adducts of the above-described bisphenols (e.g., ethylene oxide, propylene oxide, and, butylene oxide). Among the above-described examples, alkylene glycols having 2 to 12 carbon atoms and alkylene oxide adducts of bisphenols are preferably used. More preferably, the alkylene glycols having 2 to 12 carbon atoms and the alkylene oxide adducts of bisphenols are used together. Specific examples of the polyol having 3 or more valances (TO) include aliphatic polyols having 3 to 8 or more valances (e.g., glycerin, trimethylolethane, trimethylol propane, pentaerythritol, and sorbitol), phenols having 3 or more valances (e.g., trisphenol PA, phenol novolac, and cresol novolac), and alkylene oxide adducts of polyphenols having 3 or more valances.

Specific examples of the polycarboxylic acids (PC) include dicarboxylic acids (DIC) and polycarboxylic acids having 3 or more valances (TC). The DIC alone, and a mixture of the DIC and a smaller amount of the TC are preferably used as the PC. Specific examples of the dicarboxylic acids (DIC) include alkylene dicarboxylic acids (e.g., succinic acid, adipic acid, and sebacic acid), alkenylene dicarboxylic acids (e.g., maleic acid and fumaric acid), and aromatic dicarboxylic acids (e.g., phthalic acid, isophthalic acid, terephthalic acid, and naphthalene dicarboxylic acid). Among the above-described examples, alkenylene dicarboxylic acids having 4 to 20 carbon atoms and aromatic dicarboxylic acids having 8 to 20 carbon atoms are preferably used. Specific examples of the polycarboxylic acids having 3 or more valances (TC) include aromatic polycarboxylic acids having 9 to 20 carbon atoms (e.g., trimellitic acid and pyromellitic acid). The polycarbpxylic acid (PC) may be reacted with the polyol (PO) using acid anhydrides or lower alkyl esters (e.g., methyl ester, ethyl ester, and isopropyl ester) of the above-described materials.

A ratio of the polyol (PO) and the polycarboxylic acid (PC) is normally set in a range between 2/1 and 1/1, preferably between 1.5/1 and 1/1, and more preferably between 1.3/1 and 1.02/1 as an equivalent ratio [OH]/[COOH] between a hydroxyl group [OH] and a carboxyl group [COOH].

The polycondensation reaction between the polyol (PO) and the polycarboxylic acid (PC) is carried out by heating the PO and the PC to from 150° C. to 280° C. in the presence of a known catalyst for esterification such as tetrabutoxy titanate and dibutyltin oxide and removing produced water under a reduced pressure as necessary to obtain a polyester having hydroxyl groups. The polyester preferably has a hydroxyl value not less than 5, and an acid value of from 1 to 30, and preferably from 5 to 20. When the polyester has the acid value within the range, the resultant toner tends to be negatively charged to have good affinity with a recording paper, and lower-temperature fixability of the toner on the recording paper improves.

However, when the acid value is too large, the resultant toner is not stably charged and the stability becomes worse by environmental variations. The polyester preferably has a weight-average molecular weight of from 10,000 to 400,000, and more preferably form 20,000 to 200,000. When the weight-average molecular weight is too small, offset resistance of the resultant toner deteriorates. By contrast, when the weight-average molecular weight is too large, lower-temperature fixability thereof deteriorates.

The polyester preferably includes a urea-modified polyester as well as an unmodified polyester obtained by the above-described polycondensation reaction. The urea-modified polyester is prepared by reacting a polyisocyanate compound (PIC) with a carboxyl group or a hydroxyl group at the end of the polyester obtained by the above-described polycondensation reaction to form a polyester prepolymer (A) having an isocyanate group, and reacting amine with the polyester prepolymer (A) to crosslink and/or elongate a molecular chain thereof.

Specific examples of the polyisocyanate compound (PIC) include aliphatic polyisocyanates (e.g., tetramethylene diisocyanate, hexamethylene diisocyanate, and 2,6-diisocyanate methylcaproate), alicyclic polyisocyanates (e.g., isophoron diisocyanate and cyclohexyl methane diisocyanate), aromatic diisocyanates (e.g., trilene diisocyanate and diphenylmethane diisocyanate), aromatic aliphatic diisocyanates (e.g., α, α, α', α'-tetramethyl xylylene diisocyanate), isocyanurates, materials blocked against the polyisocyanate with phenol derivatives, oxime, caprolactam or the like, and combinations of two or more of the above-described materials.

The PIC is mixed with the polyester such that an equivalent ratio [NCO]/[OH] between an isocyanate group [NCO] in the PIC and a hydroxyl group [OH] in the polyester is typically in a range between 5/1 and 1/1, preferably between 4/1 to 1.2/1, and more preferably between 2.5/1 to 1.5/1. When [NCO]/[OH] is too large, lower-temperature fixability of the resultant toner deteriorates. When [NCO]/[OH] is too small, a urea content in ester of the modified polyester decreases and hot offset resistance of the resultant toner deteriorates.

The polyester prepolymer (A) typically includes a polyisocyanate group of from 0.5 to 40% by weight, preferably from 1 to 30% by weight, and more preferably from 2 to 20% by weight. When the content is too small, hot offset resistance of the resultant toner deteriorates, and in addition, the heat resistance and lower-temperature fixability of the toner also deteriorate. By contrast, when the content is too large, lower-temperature fixability of the resultant toner deteriorates.

The number of the isocyanate groups included in a molecule of the polyester prepolymer (A) is at least 1, preferably from 1.5 to 3 on average, and more preferably from 1.8 to 2.5 on average. When the number of the isocyanate group is too small per 1 molecule, the molecular weight of the urea-modified polyester decreases and hot offset resistance of the resultant toner deteriorates.

Specific examples of amines (B) reacted with the polyester prepolymer (A) include diamines (B1), polyamines (B2) having 3 or more amino groups, amino alcohols (B3), amino mercaptans (B4), amino acids (B5), and blocked amines (B6) in which the amines (B1 to B5) described above are blocked.

Specific examples of the diamines (B1) include aromatic diamines (e.g., phenylene diamine, diethyltoluene diamine, and 4,4'-diaminodiphenyl methane), alicyclic diamines (e.g., 4,4'-diamino-3,3'-dimethyldicyclohexylmethane, diamine cyclohexane, and isophoron diamine), and aliphatic diamines (e.g., ethylene diamine, tetramethylene diamine, and hexamethylene diamine).

Specific examples of the polyamines (B2) having three or more amino groups include diethylene triamine and triethylene tetramine. Specific examples of the amino alcohols (B3) include ethanol amine and hydroxyethyl aniline. Specific examples of the amino mercaptan (B4) include aminoethyl mercaptan and aminopropyl mercaptan.

Specific examples of the amino acids (B5) include amino propioic acid and amino caproic acid. Specific examples of the blocked amines (B6) include ketimine compounds prepared by reacting one of the amines B1 to B5 described above with a ketone such as acetone, methyl ethyl ketone and methyl isobutyl ketone; and oxazoline compounds. Among the above-described amines (B), diamines (B1) and a mixture of the B1 and a smaller amount of B2 are preferably used.

A mixing ratio [NCO]/[NHx] of the content of isocyanate groups in the prepolymer (A) to that of amino groups in the amine (B) is typically from 1/2 to 2/1, preferably from 1.5/1 to 1/1.5, and more preferably from 1.2/1 to 1/1.2. When the mixing ratio is too large or small, molecular weight of the urea-modified polyester decreases, resulting in deterioration of hot offset resistance of the toner.

The urea-modified polyester may include a urethane bonding as well as a urea bonding. The molar ratio (urea/urethane) of the urea bonding to the urethane bonding is typically from 100/0 to 10/90, preferably from 80/20 to 20/80, and more preferably from 60/40 to 30/70. When the content of the urea bonding is too small, hot offset resistance of the resultant toner deteriorates. The urea-modified polyester is prepared by a method such as a one-shot method. The PO and the PC are heated to from 150° C. to 280° C. in the presence of a known esterification catalyst such as tetrabutoxy titanate and dibutyltin oxide, and removing produced water while optionally depressurizing to prepare polyester having a hydroxyl group. Next, the polyisocyanate (PIC) is reacted with the polyester at from 40° C. to 140° C. to form a polyester prepolymer (A) having an isocyanate group. Further, the amines (B) are reacted with the polyester prepolymer (A) at from 0° C. to 140° C. to form a urea-modified polyester.

When the polyisocyanate (PIC), and the polyester prepolymer (A) and the amines (B) are reacted, a solvent may optionally be used. Specific examples of the solvents include inactive solvents with the PIC such as aromatic solvents (e.g., toluene and xylene), ketones (e.g., acetone, methyl ethyl ketone and methyl isobutyl ketone), esters (e.g., ethyl acetate), amides (e.g., dimethylformamide and dimethylacetamide), and ethers (e.g., tetrahydrofuran).

A reaction terminator may optionally be used in the cross-linking and/or the elongation reaction between the polyester prepolymer (A) and the amines (B) to control a molecular weight of the resultant urea-modified polyester. Specific examples of the reaction terminators include monoamines (e.g., diethylamine, dibutylamine, butylamine and laurylamine), and their blocked compounds (e.g., ketimine compounds).

The weight-average molecular weight of the urea-modified polyester is not less than 10,000, preferably from 20,000 to 10,000,000, and more preferably from 30,000 to 1,000,000. When the weight-average molecular weight is too small, hot offset resistance of the resultant toner deteriorates. The number-average molecular weight of the urea-modified polyester is not particularly limited when the above-described unmodified polyester resin is used in combination. Specifically, the weight-average molecular weight of the urea-modified polyester resins has priority over the number-average molecular weight thereof. However, when the urea-modified polyester is used alone, the number-average molecular weight is from 2,000 to 15,000, preferably from 2,000 to 10,000, and more preferably from 2,000 to 8,000. When the number-average molecular weight is too large, low temperature fixability of the resultant toner and glossiness of full color images deteriorate.

A combination of the urea-modified polyester and the unmodified-polyester improves low temperature fixability of the resultant toner and glossiness of color images produced thereby, and is more preferably used than using the urea-modified polyester alone. Further, the unmodified polyester may include modified polyester other than the urea-modified polyester.

It is preferable that the urea-modified polyester at least partially mixes with the unmodified polyester to improve the low temperature fixability and hot offset resistance of the resultant toner. Therefore, the urea-modified polyester preferably has a composition similar to that of the unmodified polyester.

A mixing ratio between the unmodified polyester and the urea-modified polyester is from 20/80 to 95/5, preferably from 70/30 to 95/5, more preferably from 75/25 to 95/5, and even more preferably from 80/20 to 93/7. When the content of the urea-modified polyester is too small, the hot offset resistance deteriorates, and in addition, it is disadvantageous to have both high temperature preservability and low temperature fixability.

The binder resin including the unmodified polyester and urea-modified polyester preferably has a glass transition temperature (Tg) of from 45° C. to 65° C., and preferably from 45° C. to 60° C. When the glass transition temperature is too low, the high temperature preservability of the toner deteriorates. By contrast, when the glass transition temperature is too high, the low temperature fixability deteriorates.

Because the urea-modified polyester is likely to be present on a surface of the parent toner, the resultant toner has better heat resistance preservability than known polyester toners even though the glass transition temperature of the urea-modified polyester is low.

(Colorant)

Specific examples of the colorants for use in the toner 9 according to illustrative embodiments include, but are not limited to, any known dyes and pigments such as carbon black, Nigrosine dyes, black iron oxide, NAPHTHOL YELLOW S, HANSA YELLOW (10G, 5G, and G), Cadmium Yellow, yellow iron oxide, loess, chrome yellow, Titan Yellow, polyazo yellow, Oil Yellow, HANSA YELLOW (GR, A, RN, and R), Pigment Yellow L, BENZIDINE YELLOW (G and GR), PERMANENT YELLOW (NCG), VULCAN FAST YELLOW (5G and R), Tartrazine Lake, Quinoline Yellow Lake, ANTHRAZANE YELLOW BGL, isoindolinone yellow, red iron oxide, red lead, orange lead, cadmium red, cadmium mercury red, antimony orange, Permanent Red 4R, Para Red, Fire Red, p-chloro-o-nitroaniline red, Lithol Fast Scarlet G, Brilliant Fast Scarlet, Brilliant Carmine BS, PERMANENT RED (F2R, F4R, FRL, FRLL, and F4RH), Fast Scarlet VD, VULCAN FAST RUBINE B, Brilliant Scarlet G, LITHOL RUBINE GX, Permanent Red F5R, Brilliant Carmine 6B, Pigment Scarlet 3B, Bordeaux 5B, Toluidine Maroon, PERMANENT BORDEAUX F2K, HELIO BORDEAUX BL, Bordeaux 10B, BON MAROON LIGHT, BON MAROON MEDIUM, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, INDANTHRENE BLUE (RS and BC), Indigo, ultramarine, Prussian blue, Anthraquinone Blue, Fast Violet B, Methyl Violet Lake, cobalt violet, manganese violet; dioxane violet, Anthraquinone Violet, Chrome Green, zinc green, chromium oxide, viridian, emerald green, Pigment Green B, Naphthol Green B, Green Gold, Acid Green Lake, Malachite Green Lake, Phthalocyanine Green, Anthraquinone Green, titanium oxide, zinc oxide, and lithopone. These materials can be used alone or in combination. The toner particles preferably include the colorant in an amount of from 1 to 15% by weight, and more preferably from 3 to 10% by weight.

The colorant for use in the present invention can be used as a masterbacth pigment when combined with a resin. Specific examples of binder resins for use in the masterbacth pigment or for use in combination with masterbacth pigment include styrene polymers and substituted styrene polymers such as polystyrene, poly-p-chlorostyrene, and polyvinyltoluene, or their copolymers with vinyl compounds, polymethyl methacrylate, polybutylmethacrylate, polyvinyl chloride, polyvinyl acetate, polyethylene, polypropylene, polyesters, epoxy resins, epoxy polyol resins, polyurethane resins, polyamide resins, polyvinyl butyral resins, polyacrylic resins, rosin, modified rosins, terpene resins, aliphatic or alicyclic hydrocarbon resins, aromatic petroleum resins, chlorinated paraffin, and paraffin waxes. These resins are used alone or in combination.

The toner 9 used in the developing device 13 according to illustrative embodiments includes a magnetic substance in addition to or in place of the colorant to obtain a magnetic one-component toner. When no magnetic substance is included, a non-magnetic one-component toner is used as the toner 9.

As the magnetic substance for use in the toner 9, the following compounds can be used: (1) magnetic iron oxides (e.g., magnetite, maghemite, ferrite) and iron oxides including other metal oxides; (2) metals (e.g., iron, cobalt, nickel) and metal alloys of the above-described metals with aluminum, cobalt, copper, lead, magnesium, tin, zinc, antimony, beryllium, bismuth, cadmium, calcium, manganese, selenium, titanium, tungsten, vanadium, etc.; and (3) mixtures thereof.

Specific examples of the magnetic substance include, but are not limited to, $Fe_3O_4$, $\gamma$-$Fe_2O_3$, $ZnFe_2O_4$, $Y_3Fe_5O_{12}$, $CdFe_2O_4$, $Gd_3Fe_5O_{12}$, $CuFe_2O_4$, $PbFe_{12}O$, $NiFe_2O_4$, $NdFe_2O$, $BaFe_{12}O_{19}$, $MgFe_2O_4$, $MnFe_2O_4$, $LaFeO_3$, iron powder, cobalt powder, and nickel powder. The above-described materials can be used alone or in combination. Among the above-described examples, powders of $Fe_3O_4$ and $\gamma$-$Fe_2O_3$ are preferably used.

In addition, magnetic iron oxides (e.g., magnetite, maghemite, ferrite) containing a dissimilar element and mixtures thereof can also be used. Specific examples of the dissimilar elements include, but are not limited to, lithium, beryllium, boron, magnesium, aluminum, silicon, phosphorus, germanium, zirconium, tin, sulfur, calcium, scandium, titanium, vanadium, chromium, manganese, cobalt, nickel, copper, zinc, and gallium. Among the above-described examples, magnesium, aluminum, silicon, phosphorus, and zirconium are preferably used. The dissimilar element may be incorporated into the crystal lattice of an iron oxide; the oxide thereof may be incorporated into an iron oxide; or the oxide or hydroxide thereof may be present at the surface of an iron oxide. However, it is preferable that the oxide of the dissimilar element is incorporated into an iron oxide. The toner 9 preferably includes the magnetic substance in an amount of from 10 to 200 parts by weight, and more preferably from 20 to 150 parts by weight, based on 100 parts by weight of the binder resin. The magnetic material preferably has a number average particle diameter of from 0.1 to 2 μm, and more preferably from 0.1 to 0.5 μm. The number average particle diameter can be determined from a magnified photographic image obtained by a transmission-electron microscope using a digitizer.

(Charge Control Agent)

Specific examples of the charge control agent include any known charge control agents such as Nigrosine dyes, triphenylmethane dyes, metal complex dyes including chromium, chelate compounds of molybdic acid, Rhodamine dyes, alkoxyamines, quaternary ammonium salts (including fluorine-modified quaternary ammonium salts), alkylamides, phosphor and compounds including phosphor, tungsten and compounds including tungsten, fluorine-containing activators, and metal salts of salicylic acid and salicylic acid derivatives, but are not limited thereto.

Specific examples of commercially available charge control agents include, but are not limited to, BONTRON® N-03 (Nigrosine dyes), BONTRON® P-51 (quaternary ammonium salt), BONTRON® S-34 (metal-containing azo dye), BONTRON® E-82 (metal complex of oxynaphthoic acid), BONTRON® E-84 (metal complex of salicylic acid), and BONTRON® E-89 (phenolic condensation product) manufactured by Orient Chemical Industries, Ltd.; TP-302 and TP-415 (molybdenum complex of quaternary ammonium salt) manufactured by Hodogaya Chemical Co., Ltd.; COPY CHARGE® PSY VP2038 (quaternary ammonium salt), COPY BLUE® PR (triphenyl methane derivative), COPY CHARGE® NEG VP2036, and COPY CHARGE® NX VP434 (quaternary ammonium salt) manufactured by Clariant A. G.; LRA-901, and LR-147 (boron complex) manufactured by Japan Carlit Co., Ltd.; copper phthalocyanine, perylene, quinacridone, azo pigments, and polymers having a functional group such as a sulfonate group, a carboxyl group, a quaternary ammonium group, etc. Among the above-described examples, materials negatively charging the toner 9 are preferably used.

The content of the charge control agent is determined depending on the species of the binder resin used, whether or not an additive is added, and toner manufacturing method (such as dispersion method) used, and is not particularly limited. However, the content of the charge control agent is typically from 0.1 to 10 parts by weight, and preferably from 0.2 to 5 parts by weight, per 100 parts by weight of the binder resin included in the toner 9. When the content is too high, the toner has too large a charge quantity, and thereby the electrostatic force of a developing roller attracting the toner increases, resulting in deterioration of the e fluidity of the toner 9' and image density of the toner images.

(Release Agent)

A wax for use in the toner 9 as a release agent has a low melting point of from 50° C. to 120° C. When such a wax is included in the toner 9, the wax is dispersed in the binder resin and serves as a release agent at a location between a fixing roller and the toner particles. Accordingly, hot offset resistance can be improved without applying a release agent, such as oil to the fixing roller. Specific examples of the release agent include natural waxes including vegetable waxes such as carnauba wax, cotton wax, Japan wax and rice wax; animal waxes such as bees wax and lanolin; mineral waxes such ozokelite and ceresine; and petroleum waxes such as paraffin waxes, microcrystalline waxes, and petrolatum. In addition, synthesized waxes can also be used. Specific examples of the synthesized waxes include synthesized hydrocarbon waxes such as Fischer-Tropsch waxes and polyethylene waxes; and synthesized waxes such as ester waxes, ketone waxes, and ether waxes. Further, fatty acid amides such as 1,2-hydroxylstearic acid amide, stearic acid amide, and phthalic anhydride imide; and low molecular weight crystalline polymers such as acrylic homopolymer and copolymers having a long alkyl group in their side chain such as poly-n-stearyl methacrylate, poly-n-laurylmethacrylate, and n-stearyl acrylate-ethyl methacrylate copolymers can also be used.

The above-described charge control agents and release agents can be dissolved and dispersed after kneaded upon application of heat together with a master batch pigment and a binder resin, and can be added when directly dissolved or dispersed in an organic solvent.

(External Additives)

The toner particles are preferably mixed with an external additive to assist in improving the fluidity, developing property and charging ability of the toner particles. Preferable external additives include inorganic fine particles. The inorganic fine particles preferably have a primary particle diameter of from $5\times10^{-3}$ to 2 μm, and more preferably from $5\times10^{-3}$ to 0.5 μm. In addition, the inorganic fine particles preferably has a specific surface area measured by a BET method of from 20 to 500 $m^2/g$. The content of the external additive is preferably from 0.01 to 5% by weight, and more preferably from 0.01 to 2.0% by weight, based on total weight of the toner composition.

Specific examples of the inorganic fine particles include silica, alumina, titanium oxide, barium titanate, magnesium titanate, calcium titanate, strontium titanate, zinc oxide, tin oxide, quartz sand, clay, mica, sand-lime, diatom earth, chromium oxide, cerium oxide, red iron oxide, antimony trioxide, magnesium oxide, zirconium oxide, barium sulfate, barium carbonate, calcium carbonate, silicon carbide, and silicon nitride. Among the above-described examples, a combination of a hydrophobic silica and a hydrophobic titanium oxide is preferably used. In particular, when a hydrophobic silica and a hydrophobic titanium oxide each having an average particle diameter not greater than $5\times10^{-2}$ μm are used as the external additive, an electrostatic force and Van der Waals force between the external additive and the toner particles are improved. Accordingly, the resultant toner composition has a proper charge quantity. In addition, even when the toner composition is agitated in the developing device 13, the external additive is hardly released from the toner particles. As a result, image defects such as white spots and image omissions are hardly produced. Further, the amount of the toner particles remaining on the photoconductors 11 after transfer can be reduced.

When titanium oxide fine particles are used as the external additive, the resultant toner can reliably form toner images having a proper image density even when environmental conditions are changed. However, the charge rising properties of the resultant toner tend to deteriorate. Therefore, an additive amount of the titanium oxide fine particles is preferably smaller than that of silica fine particles.

The total additive amount of hydrophobic silica fine particles and hydrophobic titanium oxide fine particles is preferably from 0.3 to 1.5% by weight based on weight of the toner particles to reliably form higher-quality images without degrading charge rising properties even when images are repeatedly formed.

A method for manufacturing the toner 9 is described in detail below, but is not limited thereto.

(Method for Manufacturing Toner)

(1) The colorant, the unmodified polyester, the polyester prepolymer having an isocyanate group, and the release agent are dispersed in an organic solvent to obtain toner constituent liquid. From the viewpoint of easy removal after formation, of parent toner particles, it is preferable that the organic solvent be volatile and have a boiling point of not greater than 100° C. Specific examples of the organic solvent include toluene, xylene, benzene, carbon tetrachloride, methylene chloride, 1,2-dichloroethane, 1,1,2-trichloroethane, trichloroethylene, chloroform, monochlorobenzene, dichloroethylidene, methyl acetate, ethyl acetate, methylethylketone, and methylisobutylketone. The above-described materials can be used alone or in combination. In particular, aromatic solvent such as toluene, and xylene, and chlorinated hydrocarbon such as methylene chloride, 1,2-dichloroethane, chloroform, and carbon tetrachloride are preferably used. The toner constituent liquid preferably includes the organic solvent in an amount of from 0 to 300 parts by weight, more preferably from 0 to 100 parts by weight, and even more preferably from 25 to 70 parts by weight based on 100 parts by weight of the prepolymer.

(2) The toner constituent liquid is emulsified in an aqueous medium under the presence of a surfactant and a particulate resin. The aqueous medium may include water alone or a mixture of water and an organic solvent. Specific examples of the organic solvent include alcohols such as methanol, isopropanol, and ethylene glycol; dimethylformamide; tetrahydrofuran; cellosolves such as methyl cellosolve; and lower ketones such as acetone and methyl ethyl ketone.

The toner constituent liquid includes the aqueous medium in an amount of from 50 to 2,000 parts by weight, and preferably from 100 to 1,000 parts by weight based on 100 parts by weight of the toner constituent liquid. When the amount of the aqueous medium is too small, the toner constituent liquid is not well dispersed and toner particles having a predetermined particle diameter cannot be formed. By contrast, when the amount of the aqueous medium is too large, production costs increase.

A dispersant such as a surfactant or an organic particulate resin is optionally included in the aqueous medium to improve the dispersion therein.

Specific examples of the surfactants include anionic surfactants such as alkylbenzene sulfonic acid salts, α-olefin sulfonic acid salts, and phosphoric acid salts; cationic surfactants such as amine salts (e.g., alkyl amine salts, aminoalcohol fatty acid derivatives, polyamine fatty acid derivatives, and imidazoline) and quaternary ammonium salts (e.g., alkyltrimethyl ammonium salts, dialkyldimethyl ammonium salts, alkyldimethyl benzyl ammonium salts, pyridinium salts, alkyl isoquinolinium salts, and benzethonium chloride); nonionic surfactants such as fatty acid amide derivatives and polyhydric alcohol derivatives; and ampholytic surfactants such as alanine, dodecyldi(aminoethyl)glycin, di(octylaminoethyle)glycin, and N-alkyl-N,N-dimethylammonium betaine.

A surfactant having a fluoroalkyl group can achieve a dispersion having high dispersibility even when a smaller amount of the surfactant is used. Specific examples of anionic surfactants having a fluoroalkyl group include fluoroalkyl carboxylic acids having from 2 to 10 carbon atoms and their metal salts, disodium perfluorooctanesulfonylglutamate, sodium 3-[ω-fluoroalkyl(C6-C11)oxy]-1-alkyl(C3-C4) sulfonate, sodium-[ω-fluoroalkanoyl(C6-C8)-N-ethylamino]-1-propane sulfonate, fluoroalkyl(C11-C20) carboxylic acids and their metal salts, perfluoroalkylcarboxylic acids (C7-C13) and their metal salts, perfluoroalkyl(C4-C12) sulfonate and their metal salts, perfluorooctanesulfonic acid diethanol amides, N-propyl-N-(2-hydroxyethyl)perfluorooctanesulfone amide, perfluoroalkyl(C6-C10)sulfoneamidepropyltrimethylammonium salts, salts of perfluoroalkyl(C6-C10)-N-ethylsulfonylglycin, and monoperfluoroalkyl(C6-C16) ethylphosphates.

Specific examples of commercially available surfactants include SURFLON® S-111, SURFLON® S-112, and SURFLON® S-113 manufactured by AGC Seimi Chemical Co., Ltd.; FRORARD FC-93, FC-95, FC-98, and FC-129 manufactured by Sumitomo 3M Ltd.; UNIDYNE DS-101 and DS-102 manufactured by Daikin Industries, Ltd.; MEGAFACE F-110, F-120, F-113, F-191, F-812, and F-833 manufactured by DIC Corporation; EFTOP EF-102, EF-103, EF-104, EF-105, EF-112, EF-123A, EF-123B, EF-306A, EF-501, EF-201, and EF-204 manufactured by JEMCO Inc.; and FUTARGENT F-100 and F-150 manufactured by Neos Co., Ltd.

Specific examples of cationic surfactants include primary and secondary aliphatic amines or secondary amino acid having a fluoroalkyl group, aliphatic quaternary ammonium salts such as perfluoroalkyl(C6-C10)sulfoneamidepropyltrimethylammonium salts, benzalkonium salts, benzetonium chloride, pyridinium salts, and imidazolinium salts. Specific examples of commercially available products thereof include SURFLON® S-121 manufactured by AGC Seimi Chemical Co., Ltd.; FRORARD FC-135 manufactured by Sumitomo 3M Ltd.; UNIDYNE DS-202 manufactured by Daikin Industries, Ltd.; MEGAFACE F-150 and F-824 manufactured by DIC Corporation; EFTOP EF-132 manufactured by JEMCO Inc.; and FUTARGENT F-300 manufactured by Neos Co., Ltd.

The resin particles are added to stabilize parent toner particles formed in the aqueous medium. Therefore, the resin particles are preferably added so as to have a coverage of from 10 to 90% over a surface of the parent toner particles. Specific examples of the resin particles include polymethylmethacrylate particles having a particle diameter of 1 μm and 3 μm, polystyrene particles having a particle diameter of 0.5 μm and 2 μm, and poly(styrene-acrylonitrile) particles having a particle diameter of 1 μm. Specific examples of commercially available products thereof include PB-200H manufactured by Kao Corporation, SGP manufactured by Soken Chemical & Engineering Co., Ltd., Technopolymer SB manufactured by Sekisui Plastics Co., Ltd., SGP-3G manufactured by Soken Chemical & Engineering Co., Ltd., and Micropearl from Sekisui Chemical Co., Ltd.

In addition, inorganic dispersants such as tricalcium phosphate, calcium carbonate, titanium oxide, colloidal silica, and hydroxy apatite can also be used.

As dispersants which can be used in combination with the above-described resin particles and inorganic dispersants, it is possible to stably disperse toner constituents in water using a polymeric protection colloid. Specific examples of such protection colloids include polymers and copolymers prepared using monomers such as acids (e.g., acrylic acid, methacrylic acid, α-cyanoacrylic acid, α-cyanomethacrylic acid, itaconic acid, crotonic acid, fumaric acid, maleic acid, and maleic anhydride), (meth)acrylic monomers having a hydroxyl group (e.g., β-hydroxyethyl acrylate, β-hydroxyethyl methacrylate, β-hydroxypropyl acrylate, β-hydroxypropyl methacrylate, γ-hydroxypropyl acrylate, γ-hydroxypropyl methacrylate, 3-chloro-2-hydroxypropyl acrylate, 3-chloro-2-hydroxypropyl methacrylate, diethyleneglycolmonoacrylic acid esters, diethyleneglycolmonomethacrylic acid esters, glycerinmonoacrylic acid esters, glycerinmonomethacrylic acid esters, N-methylolacrylamide, and N-methylolmethacrylamide), vinyl alcohol and its ethers (e.g., vinyl methyl ether, vinyl ethyl ether, and vinyl propyl ether), esters of vinyl alcohol with a compound having a carboxyl group (e.g., vinyl acetate, vinyl propionate, and vinyl butyrate), acrylic amides (e.g., acrylamide, methacrylamide, and diacetoneacrylamide) and their methylol compounds, acid chlorides (e.g., acrylic acid chloride and methacrylic acid chloride), nitrogen-containing compounds (e.g., vinyl pyridine, vinyl pyrrolidone, vinyl imidazole, and ethylene imine), and homopolymer or co-polymer having heterocycles of the nigtroge-containnig compounds. In addition, polymers such as polyoxyethylene compounds (e.g., polyoxyethylene, polyoxypropylene, polyoxyethylenealkyl amines, polyoxypropylenealkyl amines, polyoxyethylenealkyl amides, polyoxypropylenealkyl amides, polyoxyethylene nonylphenyl ethers, polyoxyethylene laurylphenyl ethers, polyoxyethylene stearylphenyl esters, and polyoxyethylene nonylphenyl esters), and cellulose compounds (e.g., methyl cellulose, hydroxyethyl cellulose, and hydroxypropyl cellulose) can also be used as the polymeric protective colloid.

The dispersion method is not particularly limited, and well-known methods such as low speed shearing methods, high-speed shearing methods, friction methods, high-pressure jet methods, and ultrasonic methods can be used. Among the above-described methods, the high-speed shearing methods are preferably used because particles having a particle diameter of from 2 to 20 μm can be easily prepared. When a high-speed shearing type dispersion machine is used, the rotation speed is not particularly limited, but the rotation speed is typically from 1,000 to 30,000 rpm, and preferably from 5,000 to 20,000 rpm. The dispersion time is not particularly limited, but is typically from 0.1 to 5 minutes for a batch method. The temperature in the dispersion process is typically from 0° C. to 150° C. (under pressure), and preferably from 40° C. to 98° C.

(3) While the emulsion is prepared, amines (B) are added thereto to react with the polyester prepolymer (A) having an isocyanate group. This reaction is accompanied by cross-linking and/or elongation of a molecular chain. The reaction time depends on reactivity of an isocyanate structure of the prepolymer (A) and amines (B), but is typically from 10 minutes to 40 hours, and preferably from 2 to 24 hours. The reaction temperature is typically from 0° C. to 150° C., and preferably from 40° C. to 98° C. In addition, a known catalyst such as dibutyltinlaurate and dioctyltinlaurate can be used as needed.

(4) After completion of the reaction, the organic solvent is removed from the emulsified dispersion (a reactant), and subsequently, the resulting material is washed and dried to obtain a parent toner particle. The prepared emulsified dispersion is gradually heated while stirred in a laminar flow, and an organic solvent is removed from the dispersion after stirred strongly when the dispersion has a specific temperature to form a parent toner particle having the shape of a spindle. When an acid such as calcium phosphate or a material soluble in alkaline is used as a dispersant, the calcium phosphate is dissolved with an acid such as a hydrochloric acid, and washed with water to remove the calcium phosphate from the toner particle. Besides the above-described method, the organic solvent can also be removed by an enzymatic hydrolysis.

(5) A charge control agent is provided to the parent toner particle, and inorganic fine particles such as silica fine particles and titanium oxide fine particles are added thereto to obtain toner. Well-known methods using a mixer or the like are used to provide the charge control agent and to add the inorganic fine particles.

Accordingly, toner having a smaller particle diameter and a sharper particle diameter distribution can be easily obtained. Further, the strong agitation in the process of removing the organic solvent can control the toner to have a shape between a spherical shape and a spindle shape, and a surface morphology between a smooth surface and a rough surface.

Illustrative embodiments are not limited to the details described above, and various modifications and improvements are possible without departing from the spirit and scope of illustrative embodiments. It is therefore to be understood that, within the scope of the associated claims, illustrative embodiments may be practiced otherwise than as specifically described herein. For example, elements and/or features of different illustrative embodiments may be combined with each other and/or substituted for each other within the scope of illustrative embodiments.

What is claimed is:

1. A toner cartridge detachably attachable to a developing device, comprising a developer container configured to store a developer, the developer container comprising:

a first developer agitation member configured to agitate and convey the developer; and a developer guide member extending along a rotation path of the first developer agitation member, configured to conform to a shape of the rotation path.

2. A developing device, comprising:

a developer container configured to store a developer, comprising:

a first developer agitation member configured to agitate and convey the developer; and a developer guide member extending along a rotation path of the first developer agitation member, configured to conform to a shape of the rotation path; and a developing unit provided below the developer container, comprising:

a developer bearing member rotatably provided facing a latent image bearing member, configured to bear the developer to be supplied to the latent image bearing member; and a restriction member pressed against the developer bearing member to restrict an amount of the developer borne by the developer bearing member, wherein:

the developer guide member prevents the developer from being directly supplied to a restriction nip formed between the developer bearing member and the restriction member and guides the developer to the developer bearing member;

a height of a cross section of the developer agitation member in a shaft direction is gradually reduced from a maximum height thereof relative to a direction of rotation of the developer agitation member to reduce resistance to the developer; and an edge of the developer guide member is positioned between the restriction nip and a center of rotation of the first developer agitation member.

3. The developing device according to claim 2, wherein a supply nip formed between the developer bearing member and a developer supply member is positioned between the restriction nip and the edge of the developer guide member.

4. The developing device according to claim 1, further comprising a second developer agitation member above the developer supply member, wherein the center of rotation of the first developer agitation member is positioned between the edge of the developer guide member and a center of rotation of the second developer agitation member.

5. The developing device according to claim 2, wherein the developer guide member is integrated into a housing of the developing device.

6. The developing device according to claim 2, wherein the developer guide member is provided at one of a first location and a second location, the first location being between a housing of the developing device and the restriction member, the second location being on an inner surface of the housing.

7. The developing device according to claim 2, wherein the cross section of the first developer agitation member in the shaft direction has a leading edge in a direction of rotation of the first developer agitation member.

8. The developing device according to claim 7, wherein the cross section of the first developer agitation member has a circular or triangular shape.

9. The developing device according to claim 2, wherein the developer container is detachably attachable to the developing device.

10. The developing device according to claim 2, wherein the developer has a volume average particle diameter (Dv) of from 3 to 8 μm, and a ratio (Dv/Dn) of the volume average particle diameter (Dv) to a number average particle diameter (Dn) of from 1.00 to 1.40.

11. The developing device according to claim 2, wherein the developer has shape factors SF-1 of from 100 to 180, and SF-2 of from 100 to 180.

12. The developing device according to claim 2, wherein the developer is prepared by subjecting a toner constituent liquid in which a polyester prepolymer having a functional group containing a nitrogen atom, a polyester, a colorant, and a release agent is dissolved or dispersed in an organic solvent to at least one of a cross-linking reaction and an elongation reaction in an aqueous solvent.

13. A process cartridge detachably attachable to an image forming apparatus, comprising:

an image bearing member; and the developing device according to claim 2.

14. An image forming apparatus, comprising:

a latent image bearing member configured to bear an electrostatic latent image;

a charging device configured to charge a surface of the latent image bearing member;

an irradiating device configured to scan and irradiate a charged surface of the latent image bearing member with a light beam according to image data to form an electrostatic latent image thereon;

a developing device configured to develop the electrostatic latent image with a developer to form a toner image;

a transfer device configured to transfer the toner image onto a recording medium;

a fixing device configured to fix the toner image on the recording medium; and a cleaning device configured to remove toner particles remaining on the latent image bearing member, wherein the developing device is the developing device according to claim 2.

15. A developing device, comprising:

a developer container configured to store a developer, the developer container including, a first developer agitation member configured to agitate and convey the developer; and a developer guide member extending along a rotation path of the first developer agitation member, configured to conform to a shape of the rotation path; and a developing unit provided below the developer container, the developing unit including, a developer bearing member rotatably provided facing a latent image bearing member, configured to bear the developer to be supplied to the latent image bearing member; and a restriction member pressed against the developer bearing member to restrict an amount of the developer borne by the developer bearing member, wherein the developer guide member prevents the developer from being directly supplied to a restriction nip formed between the developer bearing member and the restriction member and guides the developer to the developer bearing member.

16. The developing device according to claim 15, wherein a supply nip formed between the developer bearing member and a developer supply member is positioned between the restriction nip and the edge of the developer guide member.

17. The developing device according to claim 16, further comprising a second developer agitation member above the developer supply member, wherein the center of rotation of the first developer agitation member is positioned between the edge of the developer guide member and a center of rotation of the second developer agitation member.

18. The developing device according to claim 15, wherein the cross section of the first developer agitation member in the shaft direction has a leading edge in a direction of rotation of the first developer agitation member.

19. A process cartridge detachably attachable to an image forming apparatus, comprising:

an image bearing member; and the developing device according to claim 15.

20. An image forming apparatus, comprising:

a latent image bearing member configured to bear an electrostatic latent image;

a charging device configured to charge a surface of the latent image bearing member;

an irradiating device configured to scan and irradiate a charged surface of the latent image bearing member with a light beam according to image data to form an electrostatic latent image thereon;

a developing device configured to develop the electrostatic latent image with a developer to form a toner image;

a transfer device configured to transfer the toner image onto a recording medium;

a fixing device configured to fix the toner image on the recording medium; and a cleaning device configured to remove toner particles remaining on the latent image bearing member, wherein the developing device is the developing device according to claim 15.

* * * * *